US006472051B2

(12) United States Patent
Hirabayashi et al.

(10) Patent No.: US 6,472,051 B2
(45) **Date of Patent: *Oct. 29, 2002**

(54) PRINTING MEDIUM, PRODUCTION PROCESS THEREOF, TEXTILE PRINTING PROCESS USING THE MEDIUM AND INK-JET PRINTING APPARATUS

(75) Inventors: Hiromitsu Hirabayashi, Yokohama; Masahiro Haruta, Tokyo; Shoji Koike, Yokohama; Nobuyuki Kuwabara, Kawasaki; Yuji Akiyama; Hitoshi Sugimoto, both of Yokohama; Miyuki Matsubara, Tokyo; Takashi Saito, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/936,620

(22) Filed: Sep. 24, 1997

(65) Prior Publication Data

US 2002/0028319 A1 Mar. 7, 2002

Related U.S. Application Data

(63) Continuation of application No. 08/679,151, filed on Jul. 12, 1996, now abandoned, which is a continuation of application No. 08/238,049, filed on May 4, 1994, now abandoned.

(30) Foreign Application Priority Data

| | | |
|---|---|---|
| May 10, 1993 | (JP) | 5-108226 |
| Sep. 16, 1993 | (JP) | 5-230369 |
| Feb. 4, 1994 | (JP) | 6-012768 |

(51) Int. Cl.[7] ..... B41M 5/00
(52) U.S. Cl. ..... 428/195; 442/59
(58) Field of Search ..... 428/59, 67, 71, 428/73, 195; 347/105; 442/59

(56) References Cited

U.S. PATENT DOCUMENTS

| | | | | | |
|---|---|---|---|---|---|
| 4,264,659 | A | * | 4/1981 | Pattenden | 428/35 |
| 4,442,172 | A | | 4/1984 | Oshima et al. | 428/342 |
| 4,615,709 | A | | 10/1986 | Nakao | 8/599 |
| 4,725,849 | A | | 2/1988 | Koike et al. | 346/1.1 |
| 5,024,674 | A | * | 6/1991 | Prelini et al. | 8/554 |
| 5,131,913 | A | * | 7/1992 | Martini | 8/448 |

FOREIGN PATENT DOCUMENTS

| | | | |
|---|---|---|---|
| DE | 2838028 | 3/1980 | 428/211 |
| EP | 0212655 | 3/1987 | 428/195 |
| FR | 2663653 | 12/1991 | 428/211 |
| GB | 2 252 335 | 8/1992 | |
| JP | 39005985 | 4/1939 | 428/195 |
| JP | 46040510 | 11/1971 | 428/195 |
| JP | 54056847 | 5/1979 | 428/195 |
| JP | 60071260 | 4/1985 | 428/195 |
| JP | 60134080 | 7/1985 | 428/195 |
| JP | 61055277 | 3/1986 | 428/195 |
| JP | 62053492 | 3/1987 | 428/195 |
| JP | 63-6183 | 1/1988 | |
| JP | 1210377 | 8/1989 | 428/195 |
| JP | 3046589 | 7/1991 | 428/195 |
| JP | 5169681 | 7/1993 | 428/195 |

OTHER PUBLICATIONS

Encyclopaedia Chimica, vol. 1, pp. 391–392.

English translation of German Patent Document No. 28 38 028.

English translation of French Patent Document No. 2 663 653.

* cited by examiner

*Primary Examiner*—Bruce H. Hess
(74) *Attorney, Agent, or Firm*—Fitzpatrick, Cella, Harper & Scinto

(57) ABSTRACT

Disclosed herein is a printing medium comprising a cloth and having a Clark stiffness not lower than 10, but not higher than 400 at least at its ends.

9 Claims, 10 Drawing Sheets

PRINTING MEDIUM, PRODUCTION PROCESS THEREOF, TEXTILE PRINTING PROCESS USING THE MEDIUM AND INK-JET PRINTING APPARATUS

This application is a continuation of application Ser. No. 08/679,151 filed Jul. 12, 1996, now abandoned, which is a continuation of application Ser. No. 08/238,049 filed May 4, 1994, abandoned.

BACKGROUND OF THE INVENTION

1. Field of the Invention

The present invention relates principally to a printing medium capable of recording with a recording agent such as an ink, an ink containing a solid ink in a state dissolved therein or a toner in which powder is dissolved, an ink-jet printing process using this medium, and an apparatus capable of using as an ink-jet printing apparatus in recording instruments such as copying machines and facsimiles, communication instruments, business instruments, multi-functional instruments, printers, etc. In particular, the present invention relates to a printing medium suitable for use in conducting ink-jet printing (textile printing) on a cloth using ink-jet printing means and an ink-jet printing process using this medium.

2. Related Background Art

In recent years, textile printing apparatuses making use of an ink-jet recording technique have been put to practical use, and printed cloths with high definition have come to be produced by a simple process. However, these apparatuses are all industrial printing apparatuses, and it is hence substantially difficult under the circumstances for users to easily conduct printing with high definition as they please.

As an invention relating to such an ink-jet printing process, Yoshida, et al. disclose, in Japanese Patent Application Laid-Open No. 61-55277, an ink-jet printing cloth in which a compound not substantially dyed is contained in an amount of 0.1 to 50% by weight in the cloth, and an ink-jet printing process using this cloth. According to this process, bleeding in ink-jet textile printing can be prevented. In all examples thereof, however, initial feedability of cloth in commercially-available ink-jet printers is not considered. Therefore, its use is virtually limited to a field of industrial textile printing.

As an invention by the same applicant as in the present invention, Koike, et al. disclose, in Japanese Patent Application Laid-Open No. 62-53492, a textile printing process comprising applying a recording liquid containing a water-soluble dye to a cloth by an ink-jet system and then optionally subjecting the cloth to a dyeing treatment, wherein a recording liquid-receiving layer having a viscosity of at least 1 Pa·s at 25° C. is formed on the cloth. According to this process, an ink, or the recording liquid is received in the flowable receiving layer, whereby bleeding can be prevented to obtain an ink-jet printed cloth high in quality. In an example thereof, a 100% cotton broadcloth is immersed in a liquid for the recording liquid-receiving layer having a viscosity of 2.2 Pa·s and then lightly squeezed to remove an excess amount of the liquid for the receiving layer. The thus-treated cloth is laminated on a commercially-available paper sheet for reporting to make the cloth easy to feed to an ink-jet printer, and then immediately set in the printer, thereby conducting printing on the cotton surface of the cloth. The cloth is then taken out of the printer to iron it, thereby conducting fixing. Thereafter, the cloth is washed with a neutral detergent to remove the receiving layer, thereby obtaining a printed cloth by the ink-jet printer. In another example thereof, a 50% aqueous solution of an agent for a recording liquid-receiving layer having a viscosity of 15 Pa·s is coated by a bar coater on a shirting composed of 65% of cotton and 35% of linen. The shirting is dried by hot air at 80° C. for 1 hour to obtain a printing cloth. Printing is conducted on the cloth using an ink-jet printer, followed by a dyeing treatment by ironing and washing with a neutral detergent, thereby obtaining an ink-jet printed cloth. The ink-jet printed cloths produced in the examples fully satisfy resolution of straight Lines at intervals of 1.5 mm, and moreover have neither blurring nor bleeding and are sufficient in color depth. One advantage of the above invention is also that it can be applied to not only industrial textile printing, but also textile printing for pleasure in general homes. More specifically, ink-jet textile printing can be conducted in homes so long as the liquid for the recording liquid-receiving layer, a cloth, an ink-jet printer and a dryer, and a commercially-available plain paper sheet, iron and detergent are available. Of these, the recording liquid-receiving liquid suitable for recording liquids and cloths is not commonly sold. Therefore, it is only necessary to purchase it at an ink-jet printer manufacturer or the like.

Processes other than the ink-jet recording, for example, a process in which color printing is conducted using a "Print-gokko" (manufactured by Riso Kagaku K. K.) widely spread as a simplified printing machine, followed by a heat treatment with an iron, and the like are disclosed. In the textile printing making use of such a simplified printing machine, limitations as to the size and shape of a base cloth are scarce. However, an area printed by one operation is small from the viewpoint of the evenness of printing pressure. Therefore, the printing of a wide area is conducted in plural portions under the circumstances. The process has hence involved a problem that the alignment of registers in the whole printing is difficult, and so delicate changes in color tone and expression with high definition are difficult to achieve.

In the background of the present invention, there is an ink-jet textile printing making use of an ink-jet printer as the most promising process among the conventional simple printing processes. The reason of this is that with the recent rapid advancement of ink-jet techniques, small-sized and low-priced color ink-jet recording apparatus have come to spread in a field of so-called ink-jet recording apparatuses, by which color image data transferred from a host unit or the like can be recorded on a recording medium in the form of a cut sheet such as paper using an ink-jet technique. However, the constitution disclosed in Japanese Patent Application Laid-Open No. 62-53492 has become difficult to apply to an advanced ink-jet printer in recent years as it is. More specifically, in Example 1 of the publication, the staining on the feeding means of the ink-jet printer by a liquid for a recording liquid-receiving layer, which has a high viscosity but is flowable, the easiness of feeding and feedability of a printing cloth are improved by laminating a commercially-available paper sheet for reporting on the cloth. In Example 2, a liquid for a recording liquid-receiving layer, which is higher in viscosity, is applied to the recording surface of a cloth and dried to feed the cloth to the ink-jet printer without using a base sheet. However, these processes are difficult to provide sufficient feedability to conduct high-definition printing by an automatic feeder making good use of a recent ink-jet printer which permits higher resolution and definition. In the ink-jet printer used in the above-described examples, the recording medium is manually set on a cylindrical platen which is a main feeding means. Therefore, either the cloth on which the base sheet is only laminated as described above, or the cloth by itself can be fed to the printer. However, since most of the recent ink-jet printers are constituted so as to automatically feed a recording medium to a feeding means, the above-described cloth is difficult to feed to the feeding means of such an ink-jet printer as it is.

The fibers making up the cloth have some hygroscopicity according to the ambient humidity though it may vary depending upon its kind. The degree of this moisture absorption generally becomes higher as the ambient humidity is high. If some prints are continuously obtained by feeding a cloth in an ink-jet printing apparatus, the cloth is generally fed in the form of a roll cloth or stacked cut sheets set in an automatic paper feeder. In such a case, portions of the roll cloth or cut sheets of cloth overlap with each other, and so static electricity tends to be generated at the overlapped portions. The quantity of this static electricity increases as the cloth is dried and hence absorbs less moisture. In particular, this problem becomes serious when the medium is made of synthetic fibers and is in a low-humidity environment because the hygroscopic degree of the cloth is markedly low.

SUMMARY OF THE INVENTION

It is therefore an object of the present invention to provide a simple textile printing process and an apparatus using an ink-jet technique, and more particularly to provide a simple ink-jet printing process which permits the use of an ink-jet printer capable of automatically feeding a cloth to a feeding means of the printer, an ink-jet printing apparatus which can automatically feed a cloth subjected to a pretreatment for receiving inks to a feeding means thereof to conduct printing, and a printing medium in the form of a cut sheet, which is suitable for use in such a process and apparatus.

Another object of the present invention is to provide a technique capable of applying the high-definition color representation according to the simple ink-jet textile printing process using the ink-jet technique to not only an industrial field, but also a field of textile printing for pleasure in general homes.

The above objects can be achieved by the present invention described below.

According to the present invention, there is thus provided a printing medium comprising a cloth and having a Clark stiffness not lower than 10, but not higher than 400 at least at its ends.

According to the present invention there is also provided a printing medium comprising a base material and a cloth integrally provided on one side of the base material through an ink-absorbing adhesive layer, wherein the printing medium has a Clark stiffness not lower than 10, but not higher than 400.

According to the present invention there is further provided a printing medium comprising a cloth treated with a stiffening agent and having a Clark stiffness not lower than 10, but not higher than 400.

According to the present invention there is still further provided an ink-jet textile printing process comprising printing with inks on the printing medium as described above by means of an ink-jet printing apparatus capable of feeding a cut sheet, and then separating the cloth from the base material to obtain a printed cloth.

According to the present invention there is yet still further provided an ink-jet textile printing process comprising printing with inks on the printing medium as described above by means of an ink-jet printing apparatus capable of feeding a cut sheet to obtain a printed cloth.

According to the present invention there is yet still further provided an ink-jet textile printing apparatus comprising a means for feeding a cut sheet, an ink-jet printing means for applying ink droplets to the cut sheet fed by the feeding means and a heating means for heating the cut sheet, wherein the apparatus comprises a textile printing mode for actuating the heating means when the printing medium described above is used as the cut sheet.

According to the present invention there is yet still further provided a printing medium applied with a stiffening agent having a Clark stiffness not lower than 10, but not higher than 400 and subjected to a smoothing treatment at its surface.

According to the present invention there is yet still further provided a process for producing a printing medium, which comprises the steps of applying a stiffening agent to a raw material for the printing medium to conduct a stiffening treatment in such a manner that the raw material has a Clark stiffness not lower than 10, but not higher than 400 and smoothing the raw material subjected to the stiffening treatment.

According to the present invention there is yet still further provided an ink-jet textile printing process comprising applying inks to the printing medium described above in accordance with an ink-jet system to conduct printing.

According to the present invention there is yet still further provided a printing medium suitable for use in printing with inks containing an ionic dye, wherein a stiffening agent having an ionicity which undergoes no ionic bonding to the dye and a dye-fixing agent having an ionicity opposite to that of the dye are applied to the medium.

According to the present invention there is yet still further provided an ink-jet textile printing process comprising printing on the printing medium described above in accordance with an ink-jet system.

According to the present invention there is yet still further provided a printed article obtained by printing on the printing medium described above in accordance with an ink-jet system, washing the printed medium to remove the stiffening agent from the medium and then drying the medium.

DESCRIPTION OF THE PREFERRED EMBODIMENTS

Figure 1:
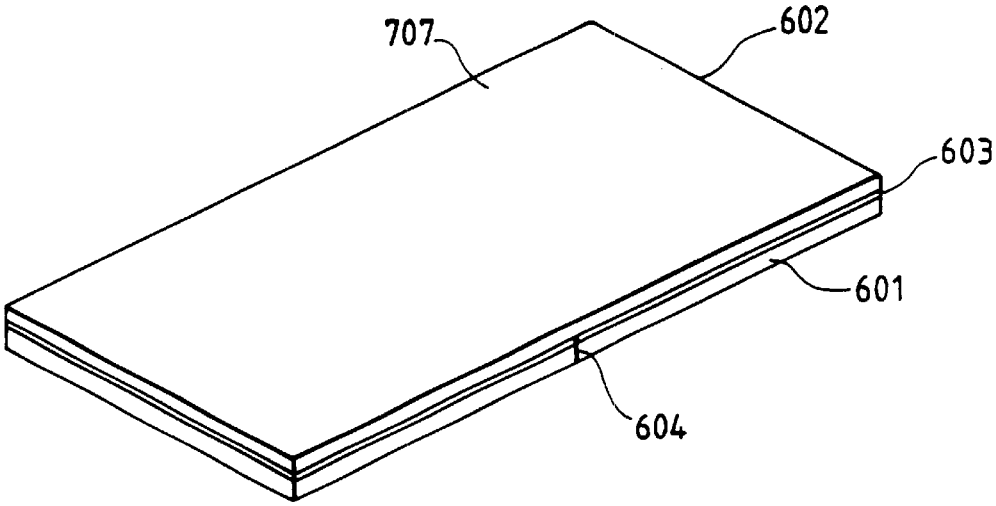
FIG. 1 is a perspective view illustrating a printing medium in the form of a cut sheet according to an embodiment of the present invention.

Cloth used:

A cloth used as a raw material for a printing medium in the present invention does not need to be special for carrying out the present invention. Cloths commonly used in various applications can be utilized. However, many of dyes or pigments used as coloring materials among components of inks used in ink-jet printing are generally anionic. Therefore, the cloth is preferably cationic from the viewpoint of more enhancing the color yield of printed images. For this reason, it is a preferred form in the application of the present invention to use a cationized cloth. As cloths to which a cationizing treatment can be subjected, may be mentioned cloths made of natural fibers such as cotton, wool and silk and cloths composed of synthetic fibers such as nylon and rayon.

The cationizing treatment means a treatment for enhancing the coloring efficiency of a dye in an ink to achieve good dyeing even when an ink used in the case where paper is used as a printing medium is used for a cloth. Specific examples thereof are described in Japanese Patent Publication Nos. 39-5985 and 46-40510, and Japanese Patent Application Laid-Open No. 60-134080.

Processes for making a cloth contain a cationic substance include the following three processes:

1. a process in which a reactive quaternary ammonium compound is reacted with fibers to add it to the fibers;

2. a process in which cationic inorganic fine particles and a binder are coated (the combined use of a crosslinking agent); and 3. a process in which an anionic-dyeable polymer is coated (the combined use of a crosslinking agent).

Specific examples of the reactive quaternary ammonium compound include the following compounds:

Example No. 1:

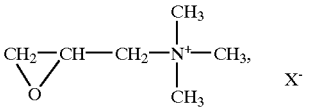

Example No. 2:

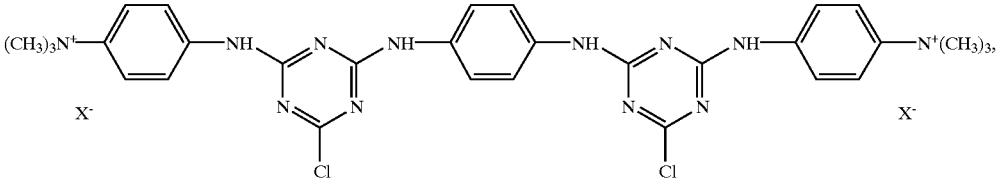

Example No. 3:

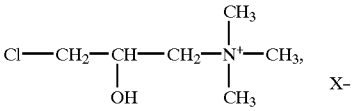

Example No. 4:

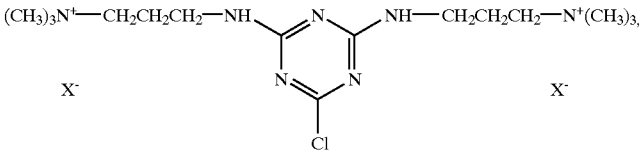

Example No. 5:

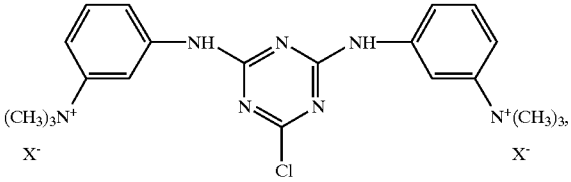

-continued
Example No. 6:
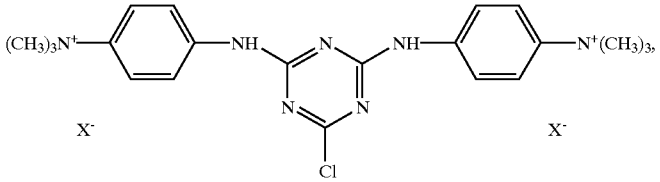
Example No. 7:
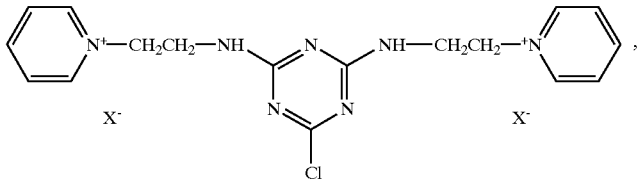
Example No. 8:
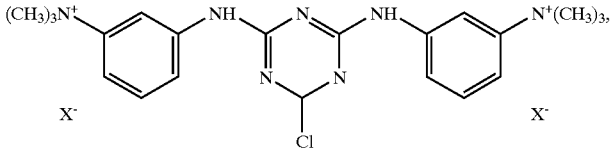
Example No. 9:
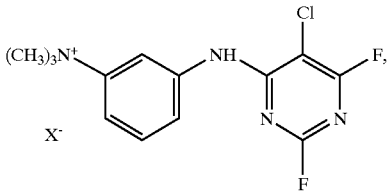
Example No. 10:
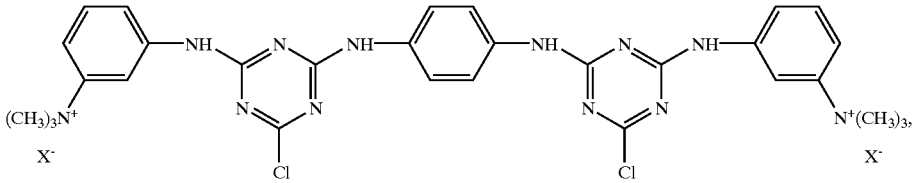
Example No. 11:
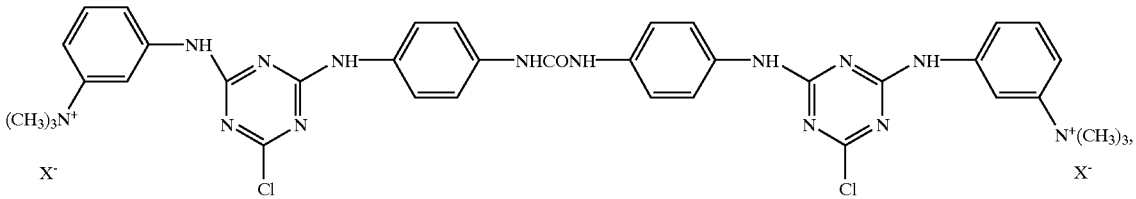
Example No. 12:
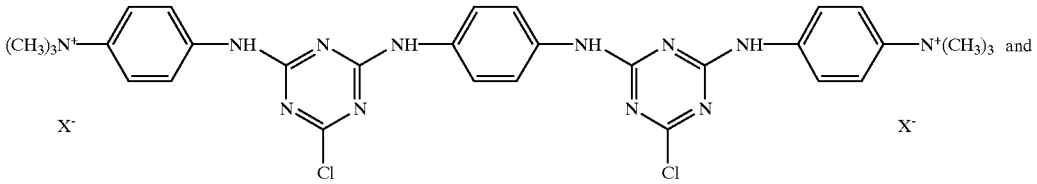

-continued

Example No. 13:

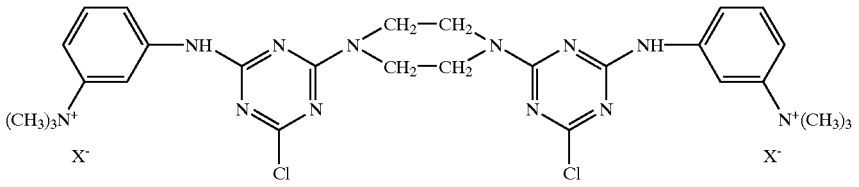

wherein X is a halogen such as Cl or Br.

Examples of the cationic inorganic fine particles include alumina sol (particle size: 5 nm to 200 nm) and the like, and specific examples thereof include Alumina Sol 100, Alumina Sol 200 and Alumina Sol 520 (products of Nissan Chemical Industries, Ltd.).

Examples of the resin binder used in combination with these cationic inorganic fine particles include gum arabic, casein, glue, soybean proteins, urea resins, melamine resins, polyacrylamide, polyamide, polyethylene-imine, sodium polyacrylate, polyvinyl alcohol, gelatin, starch, sodium alginate, polyvinyl pyrrolidone, keratin, carboxymethyl cellulose, methyl cellulose, styrenebutadiene latexes, styrene-maleic anhydride copolymers and the like.

Examples of the anionic-dyeable polymer include gum arabic, casein, glue, soybean proteins, urea resins, melamine resins, polyacrylamide, polyamide, polyurethane, polyethylene-imine, quaternary ammonium-containing polymers and the like. Examples of the crosslinking agent include bifunctional epoxy compounds, bisacrylamide, dimethylolethyleneurea, dimethylolpropyleneurea, dimethylolhydroxyethyleneurea, methylated dimethyloldimethoxyethyleneurea and the like.

The cationic substance is contained in the cloth either by coating the cloth with a solution containing at least one of these compounds or by impregnating the cloth with the solution. The amount of these substances to be applied to the cloth may vary depending upon the treatment process and the kind of compounds applied. However, it may preferably be within a range of from 0.01 to 30% by weight based on the weight of the cloth.

Stiffening treatment:

The stiffening treatment is intended to impart stiffness to a cloth for smoothly feeding the cloth by the feeding means of an ink-jet printer upon textile printing according to an ink-jet system. As processes thereof, may be mentioned a process in which a cloth is integrally laminated on one side of a base material for feeding through an ink-absorbing adhesive layer and a process in which a stiffening agent is applied to a cloth itself.

The cloth obtained by the first process is a printing medium in the form of a cut sheet having a Clark stiffness not lower than 10 but not higher than 400, in which a cloth is integrally laminated on one side of a base material for feeding through an ink-absorbing adhesive layer. The printing medium can be applied to commercially-available printers and it is ensured that it can be fed stably to printing while preventing printing failure due to the excess of ink even if an ink-jet head ejects an ink in any way. In particular, the cloth can be ensured of having more stable feedability by aligning the direction of the crosswise grain or lengthwise grain of the cloth with the feeding direction of the cloth.

The cloth can be applied to automatic cut sheet feeding (ASF), to say nothing of manual feeding, by causing a feeding member for feeding the cloth to a printing apparatus according to the operation of the printing apparatus to operate on the base material. In particular, in the case of an automatic feed system having such a constitution as a separating effect that is enhanced in addition to a separate paper-feeding means, frictional conditions may become complicated in some cases. In this case, the printing medium in the cut sheet form can be achieved having a Clark stiffness not lower than 25 but not higher than 300, thereby achieving more stable feeding.

In the second process, the control of stiffness for enhancing the feedability of a cloth is made by treating the cloth itself with a stiffening agent without recourse to the lamination of a base sheet, thereby obtaining a printing medium in the form of a cut sheet. As with the printing medium described above, the Clark stiffness intended is not lower than 10 but not higher than 400, preferably not lower than 20 but not higher than 300, within the range of which the printing medium can be applied to ink-jet printing apparatus capable of automatically feeding the medium. It is preferable that the cloth have high stiffness in the feeding means of the ink-jet printer upon ink-jet printing, the stiffening treatment itself have non-dyeing properties (a nature substantially undyed), and the dyeability of the cloth itself be kept high. Therefore, high-molecular compounds generally used as sizing agents may be applied to materials for the stiffening treatment. Examples of the materials usable as the sizing agent include carboxymethyl cellulose, polyvinyl alcohol, sodium alginate, sodium polyacrylate, polyacrylates, starch, dextrin, tragacanth gum, locust bean gum and the like. Taking the simplicity and safety of the stiffening treatment into consideration, water-soluble polymers are preferred among these. The stiffening treatment is achieved by preparing a solution from these materials, applying the solution to a cloth by a coating process such as a bar coater process, roll coater process, applicator process or screen printing and then drying the cloth. It can be also achieved by dipping the whole cloth into the stiffening solution, squeezing it by a mangle, and then drying it. It is also possible to laminate a film formed of the sizing agent on the cloth by adhesion or contact bonding. Since the sizing agent has high hygroscopicity, ink is easy to penetrate even if the sizing agent remains on the printing surface of the cloth, whereby the ink can be sufficiently penetrated into the cloth. Accordingly, the sizing agent may be applied to the cloth by either lamination or impregnation. Besides, in order to control the degree of stiffness and surface profile of the cloth, oils, waxes, high-molecular compounds, salts of inorganic compounds, fillers, antiseptics and/or the like may be suitably mixed in the solution for the stiffening treatment in addition to the sizing agents according to the kinds of the cloth and inks to be used.

The hygroscopicity of fibers is affected by its ambient humidity. Therefore, the water absorption at that time is also low as the relative humidity is low though their relation is not proportional. Natural fibers and synthetic fibers are different from each other in water absorption. The synthetic fibers are liable to be lower in water absorption than the natural fibers. If the water absorption becomes low, the friction between cloths by contact is increased, and so the cloths are easy to be electrified. Accordingly, it is easily considered that the quantity electrified increases as the humidity in an environment is low. When the printing medium which is in such a state is fed in the ink-jet printer, feeding failure of the printing medium or feeding of plural printing media at the same time, and moreover image deterioration due to electrical charge accumulated in the printing medium is brought about.

In order to prevent the charging of the printing medium, such measures as a destaticizing brush being provided are considered. Such a constitution makes the apparatus complicated and also leads to increase in cost. The sizing agent as described above exhibits good hygroscopicity by itself. Therefore, the stiffening treatment of the cloth with the sizing agent can also help the cloth to have good hygroscopicity, thereby more improving the reliability of feeding.

With respect to the amount of the sizing agent applied to the cloth upon the stiffening treatment, an amount within a range of from 0.01% by weight to 20% by weight based on the weight of the cloth suffices the cloth. The viscosity of the solution upon the treatment may be 0.001 Pa·s to 100 Pa·s.

Smoothing treatment, cutting treatment:

Even a cloth by itself can be fed to the feeding means of the ink-jet printer so long as it is subjected to the stiffening treatment. In the case where this treatment is conducted, the cloth intended is coated or impregnated with the stiffening agent in the form of a solution. Thereafter, the thus-treated cloth is subjected to a drying process for removing the solvent in the stiffening treatment solution from the cloth. At this time, the mere completion of the drying makes some difference in the evaporation rate of the solvent in the cloth according to the existing probability of the stiffening treatment solution in the cloth, the state of temperature distribution in the drying process and the thickness variation of the cloth. As a result, the cloth after the stiffening treatment may be corrugated against the thickness direction of the cloth. The present inventors have found that when such a cloth subjected to the stiffening treatment is fed to the feeding means of the ink-jet printer, irregularity may occur in the distance between the surface of the cloth and the ink ejection orifice of an ink-jet printing head, and so the impact precision of individual ink droplets ejected tends to be deteriorated.

In order to solve this problem, the cloth after completion of the stiffening treatment is subjected to a smoothing treatment. However, the smoothing treatment referred to herein is not accompanied by any complicated operation difficult to practice. Any methods well known in other fields may be applied thereto. As examples thereof, may be mentioned a process in which a cloth is inserted between two rotating rollers held in contact with each other to roll it, a process in which a cloth is held between two flat plates to press it, and a process in which a cloth is heated at the same time as the above rolling or pressing. These processes will hereinafter be described more specifically by reference to the drawings.

Figure 10:
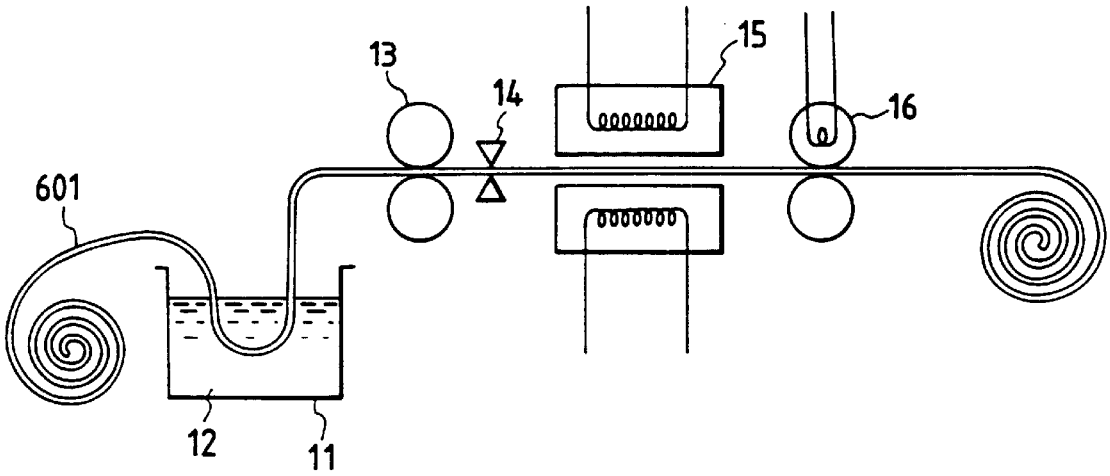
FIG. 10 is a schematic illustration showing a smoothing treatment according to an embodiment of the present invention.

Referring now to FIG. 10, a cloth 601 (a raw material for a printing medium) wound in the form of a roll is drawn out of the roll to immerse it in a stiffening treatment solution 12 contained in a container 11. The amount of the solution 12 impregnated in the cloth is then controlled by roller pair 13 rotating in contact each other. Thereafter, the stiffening treatment solution 12 applied in excess to the cloth is scraped off by doctor blades 14. The solvent in the stiffening solution attached to the cloth is then evaporated in a drying oven 15. In this state, wrinkles and warpages remain on the cloth. Therefore, the cloth is then smoothed by rollers 16 one of which has a heat source, and is successively taken up. This process is suitable for a cloth of continuous length.

Figure 11:
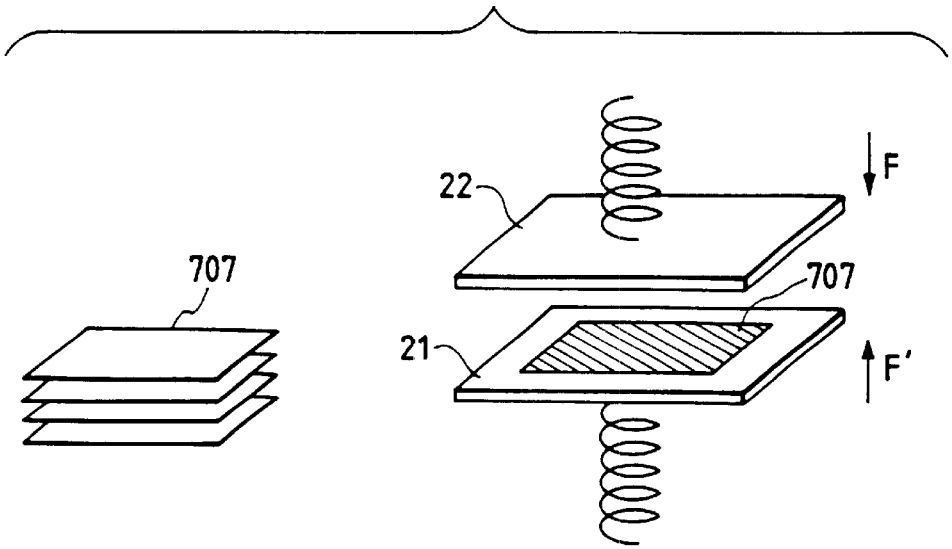
FIG. 11 is a schematic illustration showing a smoothing treatment according to another embodiment of the present invention.

On the other hand, in the case where a cloth is in the form of a cut sheet, the smoothing treatment may be conducted as illustrated in FIG. 11. More specifically, cloths 707 in the form of a cut sheet, to which the stiffening and drying treatments have been completed, are successively put between press plates 21, 22 and held therebetween for a predetermined period of time by force of F and F', thereby smoothing them. Alternatively, a household iron may be used for more brevity's sake of the smoothing treatment.

In the smoothing treatment, it is only necessary to suitably select a process and conditions from among these smoothing treatments according to the kind and thickness of the cloth to be used, the kind of the stiffening agent and the degree of corrugation after the drying. However, even in the case where complete smoothing is difficult, the cloth may be practically used if the degree of irregularities is slight. As a result of the research by the present inventors, it has been found that if the degree of the irregularities is such that the range of the irregularities in the thickness direction of the cloth upon feeding the cloth to the ink-jet printer is not wider than a half of the distance between the ink ejection orifice of an ink-jet printing head and the support surface of the cloth, such a cloth offers no problem to an image to be formed after printing.

After completion of the smoothing treatment, the cloth may be subjected to a suitable cutting treatment according to the form to be provided.

It goes without saying that the printing medium obtained in the above-described manner may be suitably treated for its transfer, circulation, storage and the like in either case of the cut sheet form or the continuous sheet such as a roll. For example, the printing medium in the cut sheet form may be put into an aluminum-deposited bag with a zipper for preventing the printability (dyeing properties) of the medium from changing upon its circulation or during its storage, and the bag may be then packed in a paperboard box to provide it. It may also be simply packaged with moisture-proof paper or the like according to its end and application.

Combined use of dye-fixing agent:

In a preferred embodiment of the present invention, a stiffening agent and a dye-fixing agent are applied to a cloth. As described above, the stiffening agent referred to herein serves to impart stiffness to the printing medium so as to permit its feeding to the feeding means of an ink-jet printer. The dye-fixing agent serves to strongly bond dye molecules at an area forming a printed image to molecules constituting the printing medium upon the printing of the printing medium. The stiffening agent is removed by washing after completion of the printing. At this time, the dye-fixing agent has an effect of preventing the dye from running out in a washing liquid.

The dyes are ionic, and dyes commonly used are often anionic, and are not special. These anionic dyes are also often used as coloring materials of printing liquids for ink-jet printing. Upon the coloring of a cloth, respective molecules of the dyes and fibers of the cloth are bonded to each other by ionic bond. Taking the ionicity of the dyes into consideration, it has been found that it is important for the stiffening agent and dye-fixing agent to have ionicity upon their application to the cloth, thus leading to completion of the present invention.

More specifically, the first object of the stiffening agent is to impart stiffness to the cloth as a printing medium to ensure that it has sufficient feedability on a feeding device of an ink-jet printer. Therefore, high-molecular compounds used as sizing agents in common dyeing field may be utilized. However, the stiffening agent is required not to react with the dyes upon printing, i.e., to have non-dyeing properties. Accordingly, it must have a nature that it undergoes no ionic bonding to the dyes. It is hence important for the stiffening agent to be anionic or nearly nonionic.

On the contrary, an important condition of the dye-fixing agent is to strongly bond to dyes by ionic bond and to be applied in a sufficient amount to the cloth as a printing medium. Therefore, it is important for the dye-fixing agent to have an ionicity opposite to that of the dyes. Thus, the dye-fixing agent must be cationic.

However, if the stiffening agent is anionic when causing both stiffening agent and dye-fixing agent to exist in the same printing medium, the stiffening agent undergoes an ionic reaction with the cationic dye-fixing agent. As a result, a salt is formed, so that the dye-fixing function is impeded. It is hence preferable that the stiffening agent be a non-anionic substance. In this instance, the ionicity of the stiffening agent may become opposite to that of the dyes in some cases. If the ionicity of the stiffening agent is strongly cationic, its non-dyeing function is impeded. Therefore, in this case, the stiffening agent must be weakly cationic or nonionic. Namely, in the printing medium used in printing which is conducted with inks comprising an ionic dye, it is an important constituent condition that a stiffening agent having an ionicity at least different from that of the dye and a dye-fixing agent having an ionicity opposite to that of the dye are applied to the medium.

According to a further investigation by the present inventors, the stiffening agent can be used without practical problems so far as the pH of its solution is within a range of from 4.5 to 8. The term "non-anionic" as will be used in the following examples means a substance the solution of which has a pH within a range of from 4.5 to 8.

The second preferred feature of the present invention is an application form of these stiffening agent and dye-fixing agent to the printing medium. More specifically, the stiffening agent and the dye-fixing agent are impregnated into the printing medium in the form of their mixture, or they are applied to the printing medium in order of the dye-fixing agent and the stiffening agent, or they are respectively applied to the opposite sides of the printing medium. The use forms for the application of the stiffening agent and dye-fixing agent are both preferably in the form of an aqueous solution to impregnate a cloth with the solution from the viewpoint of easiness of handling. It is also possible to treat the cloth with another solution than the aqueous solution so far as its solvent does not attack the cloth.

The order of the treatment with the stiffening agent and the dye-fixing agent may basically be in any way so far as the above-described ionic requirements are satisfied. However, the above-described application forms have the following respective features.

First, the case where the respective solutions are mixed with each other to treat the cloth at the same time is useful in that since the stiffening agent undergoes no ionic reaction with the dye-fixing agent if the stiffening agent is nonionic, the process is simple.

The case where the dye-fixing agent and the stiffening agent are applied in that order will now be described. If the cloth to be treated is thin, sufficient stiffness is hard to obtain unless a great amount of the stiffening agent is used. If the stiffening agent is used in the great amount as described above, the penetration of inks into the resulting printing medium may possibly be impeded. The present inventors have found that in order to avoid this possibility, it is useful to treat the cloth in order of the dye-fixing agent and then the stiffening agent. Namely, in this form, the stiffening agent tends to be dense near the surface of the cloth, and so the apparent stiffness of the cloth is easy to be heightened. Therefore, sufficient stiffness is imparted even by a relatively small amount of the stiffening agent. For this reason, inks ejected on the printing medium by an ink-jet recording system can be fully penetrated into the interior of the printing medium, so that the contact of the dyes in the inks with the dye-fixing agent is not inhibited by the stiffening agent.

Next, the case where the dye-fixing agent and the stiffening agent are respectively applied to the opposite sides of the cloth will be described. This form is intended to more effectively develop the respective functions of the stiffening agent and the dye-fixing agent. In order to increase the existing probability of the dye-fixing agent on a surface on which ink-jet printing is conducted, the treatment with the stiffening agent is conducted on the surface opposite to the printing surface, and the treatment with the dye-fixing agent is performed on the printing surface. However, no particular limitation is imposed on the priority of the surfaces to be treated. In order to make the effect of the dye-fixing agent effective, it is however preferable that the treatment of the printing surface with the dye-fixing agent be prior to the treatment with the stiffening agent.

In each of these treating processes, a drying process is required after the impregnation because the treatments are conducted on the cloth in the form of a solution. The number of steps varies according to the treating processes described above. Therefore, a suitable form may be selected according to the kind of cloth to be used, the kinds of materials and solvents of the stiffening agent and the dye-fixing agent, and the like. Needless to say, the smoothing treatment is required together with the drying in that the printing medium is fed in an ink-jet printer.

As described above, the dye-fixing agent is required to undergo ionic bonding to dyes, thereby fixing the dyes. As materials having such a nature, may be used, for example, water-soluble cationic polymers such as polyallylamine salts, polyallyl sulfone and polydimethyldiallylammonium chloride. These materials may be used in the form of a solution to conduct the treatment in the same manner as in the stiffening agent. More specifically, the solution is penetrated into or laminated on the cloth by impregnation, coating or spraying. With respect to the amount of the dye-fixing agent, also, an amount within a range of from 0.01% by weight to 20% by weight based on the weight of the cloth suffices the cloth.

Post-treatment:

The procedure of a post-treatment which is conducted after ink-jet printing will then be described. The procedure includes the following steps, i.e., a heating and steaming treatment and predetermined post-treatments such as washing and the like.

The heating treatment is conducted by, for example, a household iron or the like to more enhance the fixing ability of the resulting printed image. The sizing agent is then removed from the printed cloth by washing to return the texture of the cloth to its original one. In this treatment, the heat treatment by the iron or the like may not be necessarily conducted. If sufficient color yield is achieved on the printed cloth, the heat treatment may be omitted. However, such a treatment provides still higher image reliability.

The present invention will hereinafter be described specifically by the following examples.

The designation of "%" used in the following Examples means % by weight, unless otherwise noted.

Example 1

Figure 2:
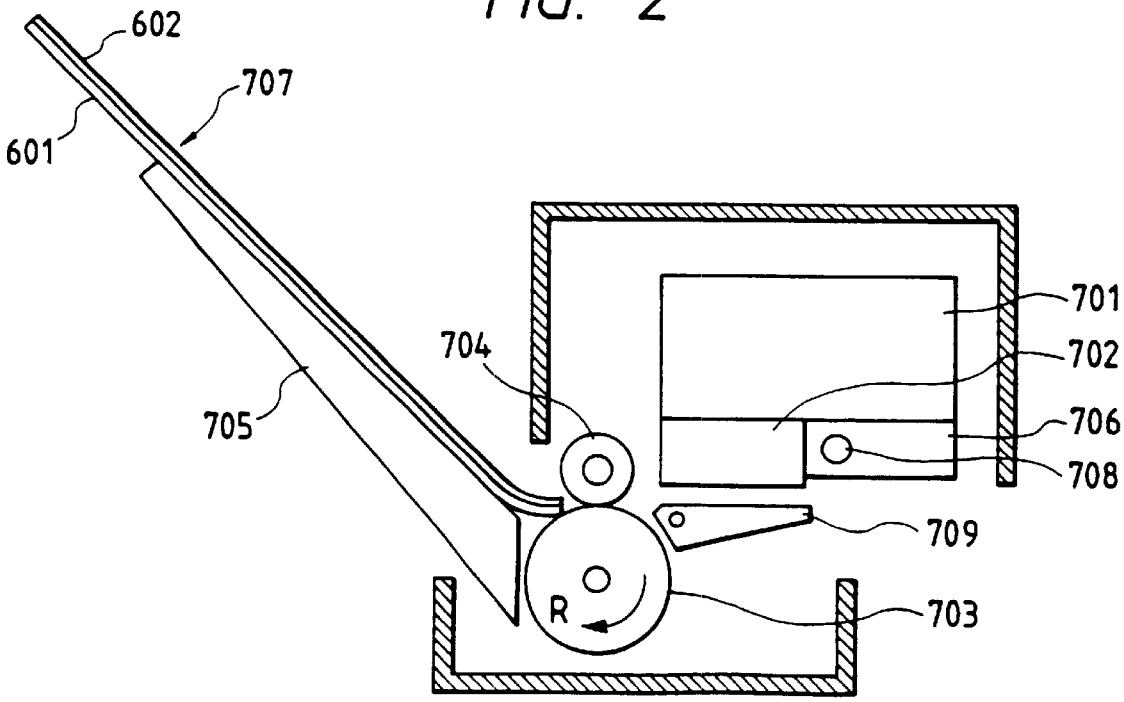
FIG. 2 illustrates principal constituent parts of an ink-jet printing apparatus according to an embodiment of the present invention.
Figure 3:
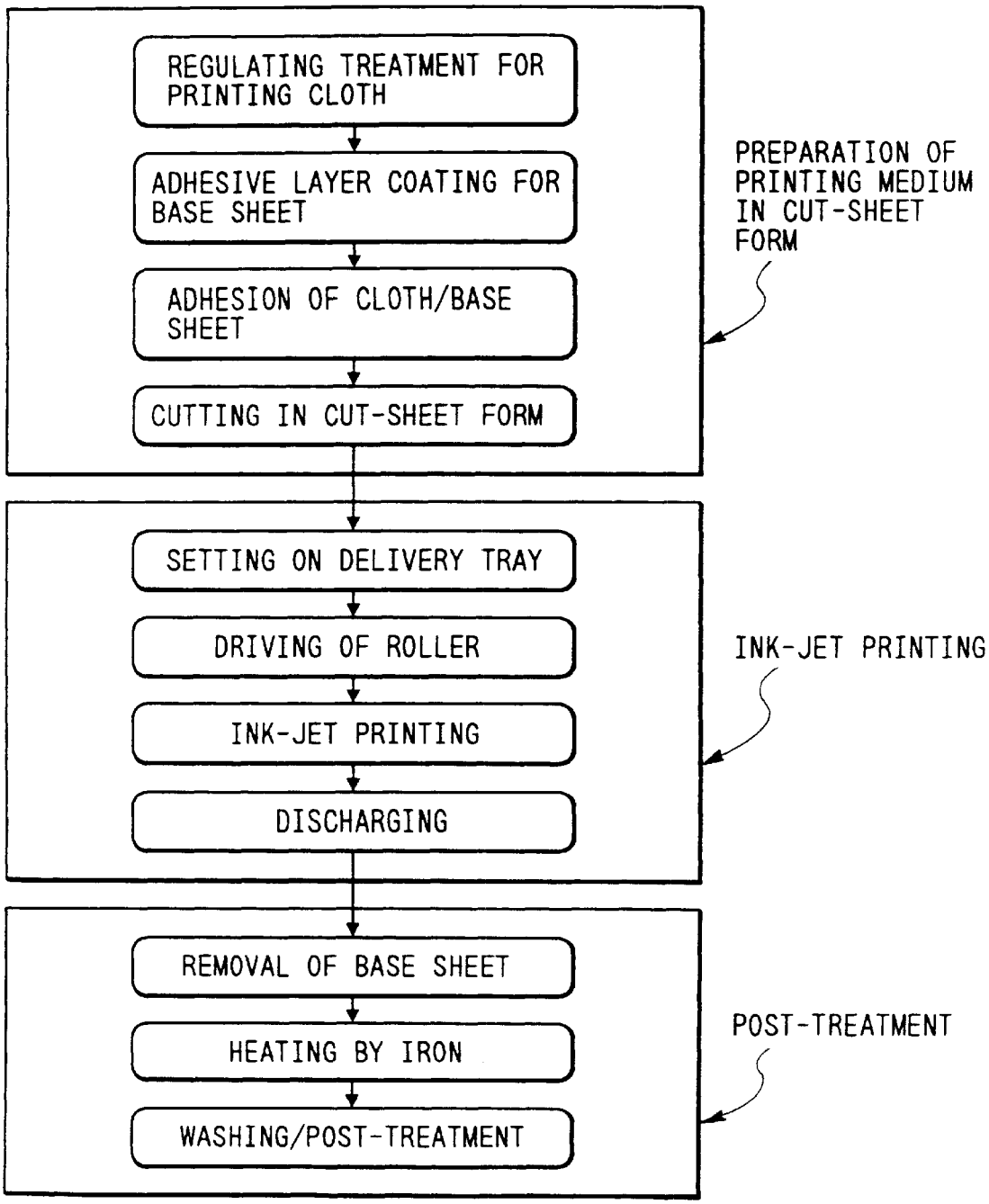
FIG. 3 is a block diagram illustrating a simple ink-jet textile printing process according to an embodiment of the present.

FIG. 2 illustrates principal parts of a feeding means for a printing medium in the form of a cut sheet, an ink-jet printing means and the printing medium in an ink-jet printing apparatus according to an embodiment of the present invention. FIG. 3 is a block diagram illustrating an ink-jet textile printing process according to Examples 1 to 3. The ink-jet textile printing process of this example is briefly described by reference to FIGS. 2 and 3. A printing medium 707 in the form of a cut sheet (hereinafter may referred to as the "printing medium" merely), which has been obtained by laminating a cloth subjected to a pretreatment (regulating treatment for printing cloth) suitable for ink-jet inks and cloth in advance on plain paper (base sheet) on the surface of which an ink-adsorbable, easily-releasable adhesive layer has been provided, is preset on the upstream side in the feeding direction of a pair of feeding rollers (drive roller 703 and driven roller 704) which is a feeding means for the printing medium in the ink-jet printing apparatus. The preparation (purging operation of an ink-jet head and setting of image data) of ink-jet textile printing is made to start a textile printing operation. First, the drive roller 703 and the driven roller 704 driven thereby start to rotate on their axes. The printing medium 707 the leading end of which is in contact with the drive roller 703 is drawn into a press contact part between the pair of rotating feeding rollers, whereby the printing medium 707 is automatically charged in the feeding means. At this time, the printing medium 707 is preset in such a manner that the surface of the printing medium 707, with which the drive roller 703 comes into contact, is a side of the base sheet 601 which is the same paper as plain paper generally often used in ink-jet printing apparatus. Therefore, the printing medium 707 can be stably fed.

Since the plain paper (base sheet) 601 of the printing medium 707, which is fed by the drive roller 703 is laminated on the cloth 602, which is a printing surface and fed under pressure by the driven roller 704, through the ink-absorbable adhesive layer 603, good feedability which permits high-definition printing by ink-jet printing can be achieved by stably feeding the base sheet by the drive roller 703. In synchronism with the feeding of the printing medium 707, an ink-jet printing part provided on a feeding path is operated to conduct printing on the cloth 602 of the printing medium 707 according to the image data. The printed medium discharged from the ink-jet printing apparatus by the feeding means after completion of the printing is air-dried and then subjected to a fixing treatment by heating or the like as needed. Thereafter, the base sheet is separated from the printed cloth, followed by the washing treatment of the ink-jet printed cloth. The thus-treated cloth is air-dried again to obtain a printed cloth in the form of a cut sheet.

The cloth 602 in this example is a 100% cotton fabric. In this example, when the 100% cotton fabric is cut into cut sheets, the grain of the fabric is substantially aligned with four sides of the cut sheet to provide the cut sheets in a rectangular form for the purpose of the further stabilization against the feedability upon the contact with the driven roller, the easiness of grain control (distinction of crosswise grain and lengthwise grain) after the printing and moreover the improvement in economical efficiency as to the number of sheets cut out from a roll of cloth.

First, the regulating treatment for printing cloth was conducted in the following manner. The cloth 602 was treated with a treatment solution A (urea: 10%, sodium hydrogencarbonate: 3%, sodium metanitrobenzenesulfonate: 1%, water: 86%) prepared according to an ink-jet ink (ink formulation B) by means of a Zimmer type printing machine using a screen of a 200-mesh solid pattern. The thus-treated cloth was dried at 100° C. for 2 minutes. As the ink formulation B, was used that obtained by stirring a mixture of 10% of C.I. Reactive Blue 49, 25% of diethylene glycol and 65% of water for 2 hours and then filtering the mixture. The adhesive layer 603 was provided on plain paper 601 with a treatment solution C. The adhesive layer 603 is preferably excellent in ink-absorbability so as to successfully absorb ink, which cannot be absorbed in the cloth, but exudes from the cloth, thereby preventing undesired spreading of ink in the cloth, though its amount may vary according to the thickness of the cloth (ink-receiving capacity) and the amount of ink to be applied in ink-jet textile printing. A 20% aqueous solution of polyvinyl alcohol was used as the treatment solution C to evenly coat the plain paper. The lamination of the cloth subjected to the regulating treatment for printing cloth and the plain paper provided with the adhesive layer was conducted by press bonding using two rubber rollers heated to 80° C.

The thus-obtained laminate was cut by a slitter along the direction of the grain of the fabric. However, the cutting line may be turned by a predetermined angle to the grain, for example, 45° depending upon the material of the cloth and the application intended so far as the cutting angle upon the cutting into the cut sheets to the direction of the grain is fixed and can be distinguished. In this example, a cut 604 was made in the plain paper as the base sheet at the same time as the cutting of the laminate, or before or after the cutting to facilitate the separation of the base sheet after the printing. In order to bring the same effect, it is permissible to partly provide the adhesive layer 603 within limits not impeding the feedability so as to provide an unlaminated portion at the trailing end or along the feeding direction.

In this example, a base sheet was laminated on a 100% cotton fabric with the basis weight of the base sheet and the direction of grain of the fabric upon the lamination varied to regulate the Clark stiffness, thereby testing the feedability. A printing medium having a Clark stiffness of 8, which had been obtained by using, as a base sheet, light-weight paper having a basis weight of at most 20 g/m$^2$ and laminating it on the fabric along the direction of a crosswise grain, was used to conduct a feeding test. As a result, the frequency in occurrence of oblique motion and wrinkles caused by feeding was high, and the frequency in occurrence of inferiority as to feedability was synthetically as high as 48/50. The printing medium was hence judged as being unfit for practical use. On the contrary, with respect to a printing medium having a Clark stiffness of 12, which had been obtained by laminating the same light-weight paper as that used above on the fabric along the direction of a lengthwise grain high in stiffness, the frequency in occurrence of feeding failure was sharply reduced to 10/50. The degree of the inferiority itself was also lessened as demonstrated by the fact that some oblique motion occurred, but there was no fatal inferiority such as wrinkles caused by feeding. Printing media produced by using light-weight paper having a basis weight of 38 g/m$^2$ and laminating it on the fabrics along the directions of a crosswise grain and a lengthwise grain had Clark stiffness of 20 and 39, respectively. In the feeding test, both media had no inferiority, and achieved good feedability. In order to stabilize the feedability in the ink-jet printing apparatus and permit the automatic feeding, it was hence revealed that it is only necessary to raise the Clark stiffness to at least 10 by laminating the base sheet on the cloth low in stiffness. The upper and lower limits of the Clark stiffness depend on the construction of the ink-jet printing apparatus. The adhesive layer and the base sheet are selected so as to adjust the Clark stiffness preferably to 400 or lower, more preferably within a range of from not lower than 20 to not higher than 300.

The limits of the Clark stiffness are related to an angle between the angle of a tray for drop-in paper feeding and a printing direction. If the Clark stiffness is too low, it is difficult to feed the printing medium to the press contact part by its own weight and the driving force of the drive roller, which is applied to the leading end of the printing medium. On the contrary, if it is too high, it is difficult to compensate nonlinear appearance of the printing medium, such as some curling, by straightening the leading end of the printing medium making good use of the peripheral surface of the drive roller. Even if the printing medium is manually fed to the press contact part without recourse to the paper feeder tray, it is necessary to hold it along the peripheral surface of the drive roller. For these reasons, it was revealed that the above stiffness range is preferred.

In this example, the printing medium in the cut sheet form was put into an aluminum-deposited bag with a zipper for preventing the printing properties of the medium from changing upon its circulation or during its storage, and the bag was then packed in a paperboard box to provide it. It may also be simply packaged with moisture-proof paper or the like according to its end and application.

The washing after the ink-jet textile printing may be conducted by water washing with a commercially-available neutral detergent. However, a treatment agent D may be used for enhancing color yield. This treatment agent D may be provided by packing it in the form of tablets or a sheet together with the printing medium. In order to more enhance color yield, it is preferable that the printed cloth be subjected to a heat treatment by an iron prior to the washing. The treatment agent D is a fixing agent or the like and has as its main object the improvement of wet fastness.

FIG. 2 shows principal parts of an illustrative ink-jet printing apparatus according to this example. In this drawing, on a carriage 706, is mounted an integrated ink-jet printing head 702 comprising 4 ink tanks, in which 4 inks of black, cyan, magenta and yellow colors are respectively contained, and 4 printing heads 174 (which will be described subsequently) for respectively ejecting the four inks.

FIG. 2 illustrates how to automatically charge the printing medium into the pair of feeding rollers. Many of the conventional ink-jet printing apparatus are of a system in which a member for pressing a printing medium against a cylindrical platen roller is released once to manually feed the printing medium, and the pressing member is then pressed, thereby bringing the printing medium into close contact with the platen roller to charge the printing medium. According to such a printing apparatus, few limitations are imposed on the stiffness of the printing medium and the like. It was hence possible to feed even a cloth low in stiffness and make a print thereon. However, it was difficult to align the grain of such a cloth with its feeding direction or twist and feed the cloth without wrinkling because of oblique motion or the like caused by the manual setting of the cloth. It was also difficult to conduct ink-jet textile printing with high definition. Further, it was difficult to stabilize the feedability due to the reduction in pressing force by repeated use of a releasing mechanism. Besides, the operatability of feed operation itself became poor. Therefore, an apparatus by which automatic feeding can be achieved like this example is preferred.

Referring now to FIG. 2, a paper feeder tray 705 is set obliquely for stably conducting automatic feeding in this example. The paper feeder tray is constituted so as to bring the leading end of the printing medium 707 into accurate contact with the drive roller 703 simply by inserting the printing medium 707 along the paper feeder tray 705. In this state, the drive roller 703 is rotated on its axis, whereby the leading end of the printing medium 707 is accurately led to the press contact part between the pair of feeding rollers 703, 704. Therefore, the printing medium 707 is automatically charged into the pair of feeding rollers as the feeding means without causing oblique motion and wrinkles. In this example, the printing medium has been cut along its grain as described above. Therefore, an image can be stably printed on the medium in the direction of the predetermined grain, so that when the printed cloth is cut into pieces to use them in patchwork, the pattern of the print can be aligned with the grain of the cloth. Therefore, it is possible to make a high-quality work free from any strain. In the case where no paper feeder tray is provided, it is only necessary to adjust the leading end of the printing medium to the press contact part between the driving and driven rollers and then to rotate the drive roller on its axis. As described above, the printing medium according to this example has the same feedability as plain paper. Besides, known register regulating mechanisms for paper feeding can also be applied to the printing medium.

The drive roller 703 rotates together with the driven roller 704 in the direction indicated by an arrow R in FIG. 2 while pressing the printing medium 707, thereby feeding the printing medium upon occasion. The carriage 706 is constituted so as to stand by at its home position (not illustrated) when no printing is conducted or purging operation for a multi-head is conducted.

The carriage 706 situated at the home position prior to the start of printing moves along a carriage guide rod 708 according to a printing start command, while the four color inks are ejected through respective multinozzles on the printing head 174 according to a printing signal while being timed on the basis of a read signal from a linear encoder, thereby printing on the cloth by a width d. By this print scanning, the inks are impacted on the cloth in order of black, cyan, magenta and yellow inks to form dots. When printing is completed up to the end of a line, the carriage returns to its home position to conduct printing of the next line. The printing medium is fed by a width d by rotating the drive roller 703 from the end of the first printing to the start of the second printing. In such a manner, printing and paper feed by the printing width d of the printing head are conducted every one scanning of the carriage, and this scanning is conducted repeatedly to complete data printing on the whole printing medium. At the time the printing is completed, the printing medium is discharged by the feeding means, and at the same time, the platen 709 which has formed a flat printing surface for the printing is inclined in a discharging direction to assist the discharge of the trailing end of the medium. In order to assist the discharge and stably press the printing medium in the printing part, means such as spur rollers may be provided on the downstream side of the printing part.

Figure 4:
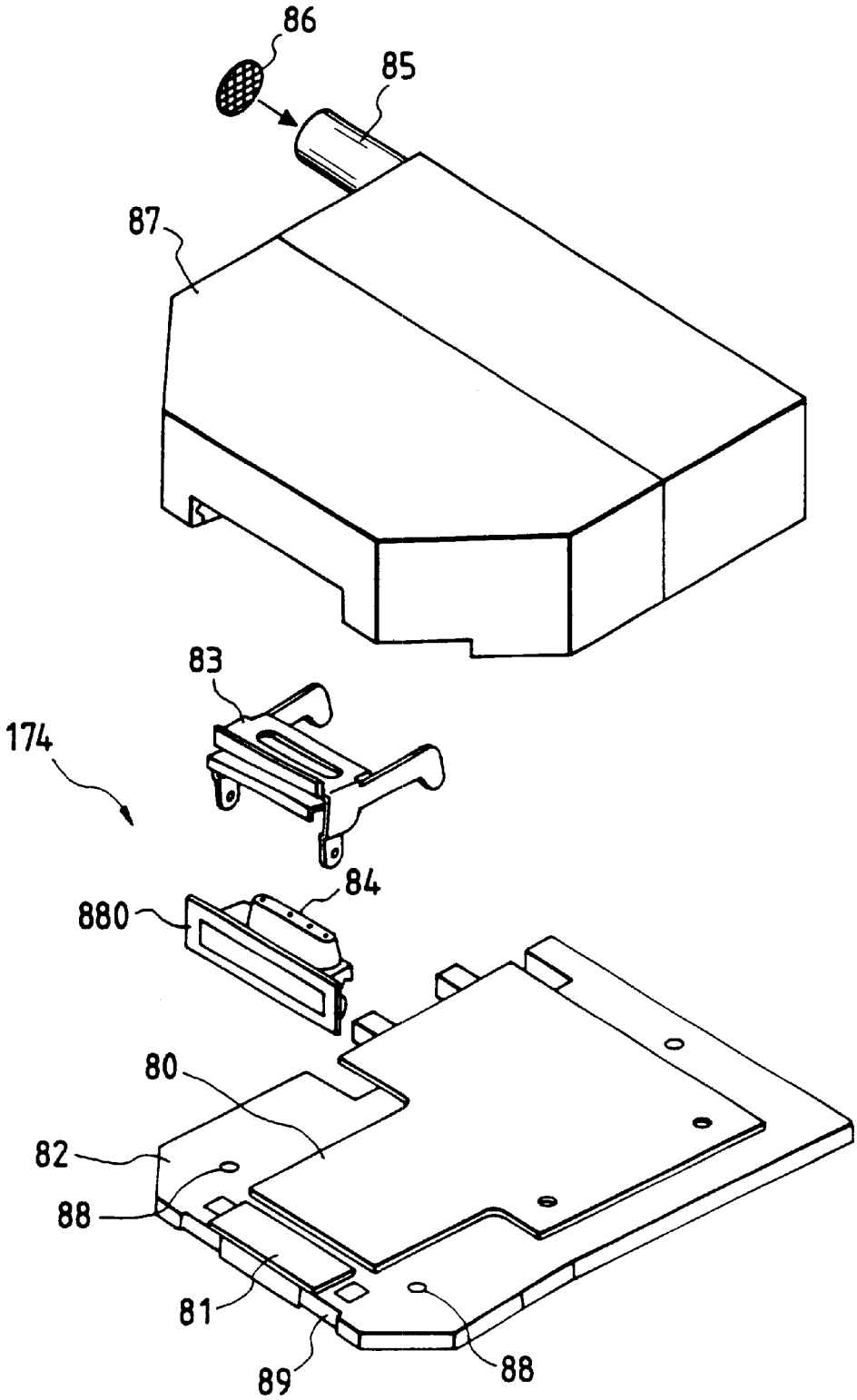
FIG. 4 illustrates constituent parts of an ink-jet printing head unit applicable to the present invention.

FIG. 4 illustrates the constitution of the printing head 174 for ejecting ink. An end of a circuit board 80 is connected to a wiring part of a heater board 81. On the other end of the circuit board 80, are provided plural pads corresponding to respective electrothermal energy converters for receiving electric signals from the main apparatus. By this constitution, the electric signals from the main apparatus are inputted to the respective electrothermal energy converters. A metallic base plate 82 for supporting the back surface of the circuit board 80 on its plane serves as a bottom plate of an ink-jet unit. A pressure bar spring 83 includes a part formed by bending in substantially a U-shaped cross section so as to linearly spring-load a region in the vicinity of ink ejection orifices of a grooved top plate 84, claws hooked in relief holes bored in a base plate, and a pair of rear legs for receiving the force acted on the spring on the base plate. By this spring force, the circuit board 80 is brought into contact under pressure with the grooved top plate 84. The attachment of the circuit board 80 to the support plate is made by mounting with an adhesive or the like.

An ink-supplying pipe 85 has a filter 86 at its end. An ink-feeding member 87 is made by molding. In the grooved top plate 84, an orifice plate 880 and flow path, through which an ink is directed to each ink feed opening, are integrally formed. The ink-supplying member 87 is simply fixed to the base plate 82 by inserting two pins (not illustrated) provided on the back surface of the ink-supplying member 87 through two holes 88 defined in the base plate 82 and then fusion-bond the pins in the holes. At this time, a gap between the orifice plate 880 and the ink-supplying member 87 is sealed. Further, a gap between the orifice plate 880 and a front end of the base plate 82 is completely sealed.

Figure 5:
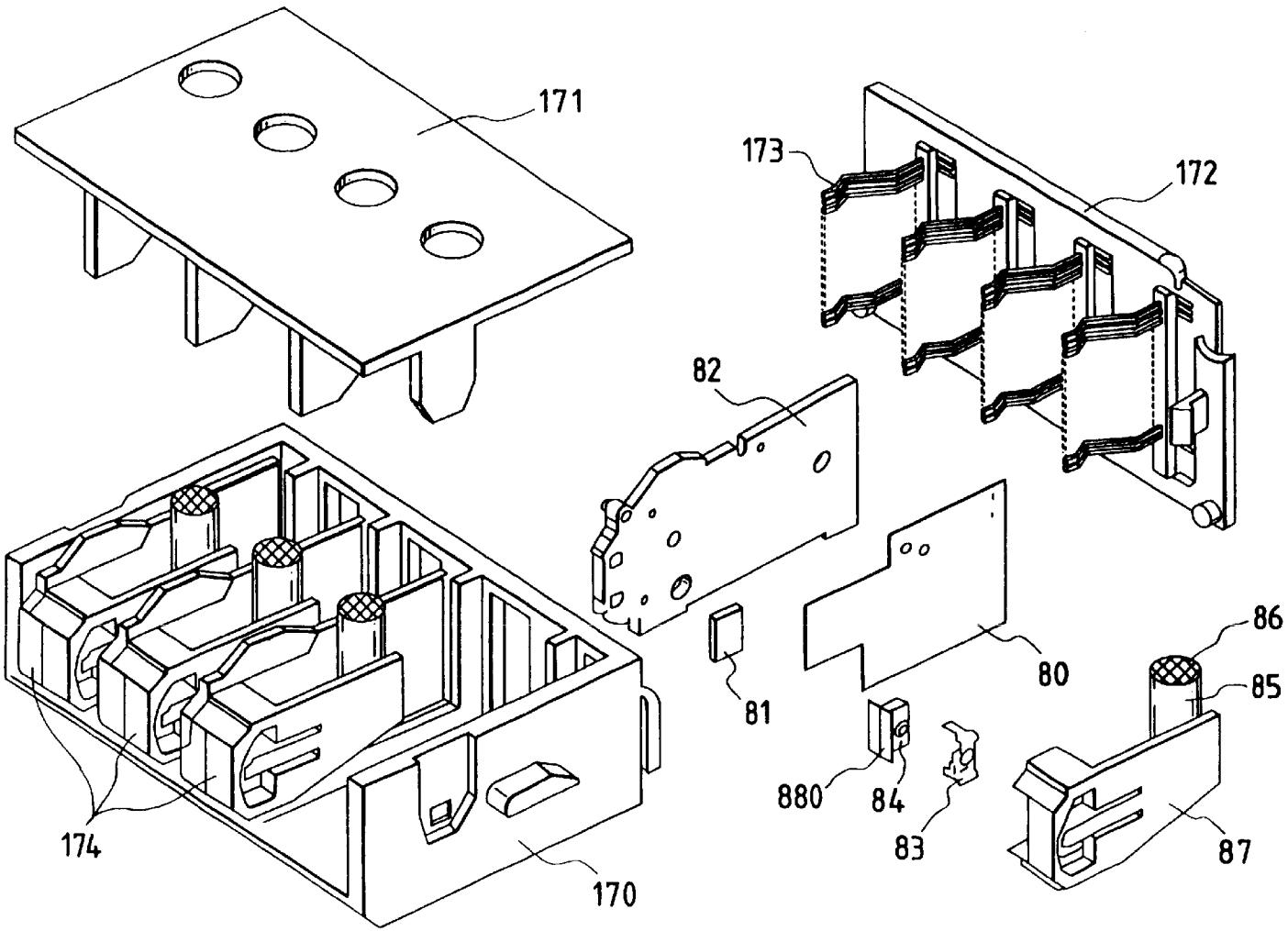
FIG. 5 illustrates constituent parts of an integrated ink-jet printing head applicable to the present invention.

FIG. 5 illustrates the structure of the integrated ink-jet printing head 702 obtained by integrally assembling the above-described four heads 174, which can respectively eject the four inks of black, cyan, magenta and yellow colors, in a frame 170. The four printing heads are installed at predetermined intervals in the frame 170 and fixed in the state that the register in the direction of the nozzle line is aligned. In this example, the alignment is conducted using the mechanical reference plane of the heads to enhance the precision of mutual impact positions among the colors. However, it is also permissible that the printing heads are temporarily installed in the frame, the inks are actually ejected to measure impact positions, and mutual impact positions among the colors are directly regulated on the basis of the resulting measurement data, thereby further enhancing the precision. Numeral 171 indicates a frame cover, and numeral 173 designates a connector for connecting each of the pads provided on the circuit boards 80 of the four printing heads to an electric signal from the main body of the printing apparatus. The integral assembly of the four printing heads is useful in that there is an advantage from the viewpoint of handling, and besides, the precision of the mutual impact positions among the heads is enhanced as described above. It also has a great effect in that the number of signal conductors to be connected to the main body of the printing apparatus can be decreased. For example, a signal conductor common to the four heads, such as a GND line can be made common on a connector base 172 to decrease the number of lines correspondingly. Besides, if an integrated circuit board is provided to conduct time-division driving every head, a record signal conductor may also be made common. Such decrease in the number of electric connections is effective for apparatuses making use of many signal conductors, such as color printing apparatuses and multi-nozzle, high-speed printing apparatuses.

Example 2

In order to improve the stiffness of a cloth itself, the cloth was treated with a treatment solution E (urea: 10%, sodium hydrogencarbonate: 3%, sodium alginate: 0.5%, sodium metanitrobenzenesulfonate: 1%, water: 85.5%) containing a stiffening agent by means of a Zimmer type printing machine using a screen of a 200-mesh solid pattern. The thus-treated cloth was dried at 100° C. for 2 minutes. As an ink formulation F, was used that obtained by stirring a mixture of 10% of C.I. Reactive Blue 15, 25% of diethylene glycol and 65% of water for 2 hours and then filtering the mixture.

A feeding test was performed by means of the ink-jet printing apparatus illustrated in FIG. 2. As a result, good feedability was achieved, and so a high-definition printed cloth was obtained.

The washing after the ink-jet printing may be conducted by water washing with a commercially-available neutral detergent. However, a treatment agent G may be used for enhancing color yield. This treatment agent G may be provided by packing it in the form of tablets or a sheet together with the printing medium in the form of a cut sheet. In order to more enhance color yield, it is preferable that the printed cloth be subjected to a heat treatment by an iron prior to the washing. The treatment agent G is a fixing agent or the like and has as its main object the improvement of wet fastness. In this example, the post-treating agent was provided in the form of a bagged good. However, it may be absorbed in an unprinted portion (leading end part, trailing end part, etc.) of the cloth so as to dissolve out upon the water washing.

Example 3

Figure 6:
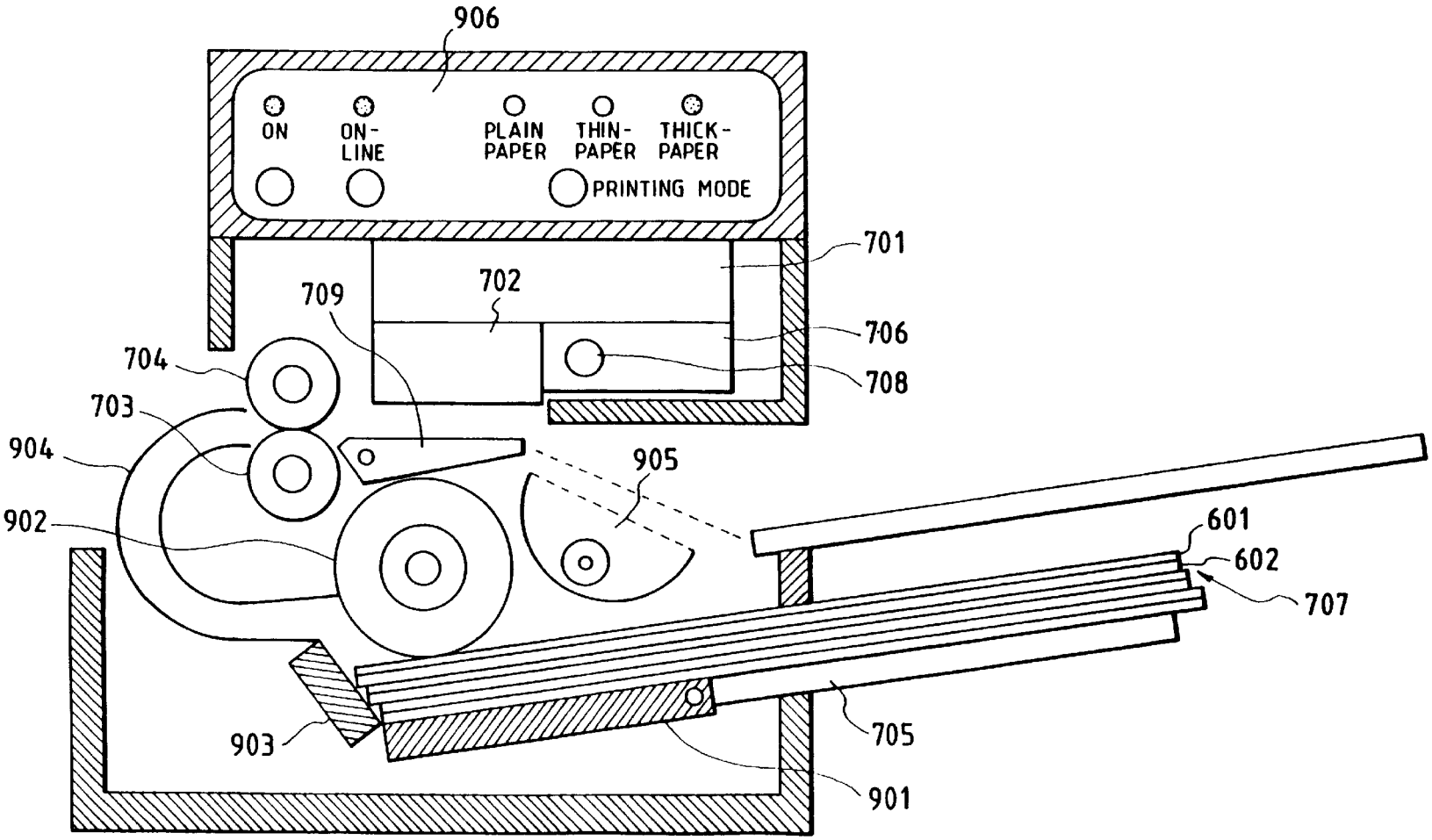
FIG. 6 illustrates principal constituent parts of an ink-jet printing apparatus according to another embodiment of the present invention.

This example describes an illustrative ink-jet printing apparatus which installs an automatic feed mechanism in addition to the automatic charging mechanism for a printing medium in the form of a cut sheet as illustrated in FIG. 6. In this example, a mechanism for heating the printing medium after ink-jet printing to enhance color yield was also given to the apparatus. Further, a printing system in an ink-jet printing part was improved to provide a selection mechanism so as to be adaptable for a thick printing medium in the form of a cut sheet.

According to the feed mechanism in this example, the printing media described in Examples 1 and 2 may also be fed. As described above, the printing medium has been subjected to the pretreatment for regulating the printing of inks. Therefore, it is not preferable from the viewpoint of feedability and printing property to drive a feeding member coming into contact with a printing surface as well as the feeding mechanism. More specifically, a driving feed member on the driving side of feeding members generally used in an ink-jet printing apparatus is made of an elastic member such as a rubber material. When the rubber material and the printing media subjected to the pretreatment are frictionally rubbed with each other, the ink-receiving properties of the rubbed portion of the printing medium is changed, so that feed marks may be left, or to the contrary, when a pretreatment agent may be transferred little by little to the rubber material, feed failure due to reduction in coefficient of friction may occur in some case. Therefore, in this example, the driving feed member is constituted so as to come into contact only with the back surface (non-printing surface) of the printing medium. The printing medium described in Example 2 has been improved in feedability without using any base sheet. Therefore, since the pretreatment agent is also applied to its back surface, a transfer-preventing treatment may be conducted further on the back surface from the viewpoint of the protection of the driving feed member. Alternatively, the back surface of the printing medium in the form of a roll prior to cutting may be subjected to a sliding friction treatment without using any special treatment agent, thereby removing the pretreatment agent possibly transferred from the back surface.

The feed mechanism in this example includes a driving feed rubber roller 902 which is rotated on its axis as needed, a feeding holder plate 901 for holding printing media in a stacked state, which vertically moves as needed, a separating pad 903 held in contact with the leading ends of the stacked printing media to separate the printing media from each other, and a feed guide 904 for sending out the printing media separated and fed to a pair of feeding rollers.

First, the feeding holder plate 901 is moved upward according to a feed signal, whereby one of the stacked printing media 707 held on the feeding holder plate 901 with their back surfaces up is brought into contact under pressure with the driving feed rubber roller 902. When the driving feed rubber roller 902 is rotated in the feeding direction in such a state, frictional sliding force is applied to the back surface of the printing medium, whereby the printing medium is fed. At this time, frictional sliding force is also generated among the stacked printing media. Therefore, a printing medium situated under the uppermost printing medium in contact with the driving feed rubber roller is also attracted by the uppermost printing medium to start being fed at the same time. When the leading ends of a plurality of the printing media started to be fed at the same time come to the separating pad 903 high in frictional force, the printing media are kept back in ascending order, so that only one printing medium is finally fed during passing through the separating pad. The printing medium separated and fed is led to a press contact part between the pair of rotating feeding rollers through the feed guide by the driving feed roller 902 still rotated, thereby automatically charging in the feeding rollers. At the time the printing medium has been automatically charged, the feeding holder plate 901 is timely moved downward. At the time the feeding force of the driving feed roller 902 comes not to be transferred to the printing medium, the rotation of the driving feed roller 902 is stopped to complete the feed operation. In this example, since the printing medium is made U-turn in the region of the feed guide to turn the printing medium upside down, the printing medium situated at the feeding part with its back surface up is held with its printing surface up at the time it passes through the pair of feeding rollers. Therefore, the ejecting direction of inks in the ink-jet printing part is downward. The ejecting direction of inks may preferably be within a range from downward to sideways though it may somewhat vary according to an ink-jet printing system used. It is only necessary to send out the printing medium in that direction by the feed guide. Using the same mechanism as that of a double-sided printing unit used in copying machines or the like in recent years, the printing medium fed once with its back surface up may be turned upside down.

In any event, an important constitution upon separating and feeding the printing medium by the feed mechanism according to this example is to limit to the constitution that the feeding operation of the printing medium is started with its back surface up. Accordingly, known systems other than the separating pad system of this example, for example, even a claw separating system may be applied. It is only necessary to bring the driving feed member into contact under pressure with the opposite side to the printing surface. As described above, some frictional sliding force is applied to the printing media in the automatic feed mechanism. Therefore, the Clark stiffness of the printing medium must be preset to a somewhat high value. It has been found that when the value is regulated within a range of preferably from not lower than 25 to not higher than 300, feed characteristics are stabilized.

Although the constitution and operation of the ink-jet printing itself are substantially the same as in Example 1, their description will be omitted. In this example, however, a heating means is provided on the downstream side of the ink-jet printing part so as to subject the printing medium to a heat treatment as needed. As the heating means, any of the heating mechanisms conventionally-known in fields of printers and copying machines may be applied so far as it is constituted so as to achieve a sufficient effect on the improvement of color yield, which is an object of this example. Besides, it is more preferable that the heating means be constituted in such a manner that heating conditions can be suitably controlled and selected according to the structure of the printing medium and the material and thickness of a cloth. In this example, an infrared heater 905 with a light reflector is used as a main heating means, and is energized and controlled under predetermined conditions in synchronism with the above-described feeding operation of the printing medium following the ink-jet printing. Since unevenness due to heating or ink evaporation may occur according to color distribution of a print pattern or the like when the heating is directly conducted from the printing surface side, the heating means is constituted so as to conduct the heating from the back surface side in this example. However, it is permissible to conduct direct heating from the printing surface side or double-sided heating according to the constitution of the heating means and heating conditions. A contact heating system making use of a heating plate or the like may also be used. In this example, a fan (not illustrated) is provided as an auxiliary means so as to prevent heat and/or steam from retaining in the vicinity of the heating part to stably heat the printing medium under control, thereby circulating air in the heating part as needed. The infrared heating is conducted from the back side of the printing medium in this example. Therefore, when the printing medium with the base sheet as described in Example 1 is used, black-colored paper may be used as the base sheet to enhance the efficiency of infrared absorption of the base sheet as the heat-receiving surface, thereby improving the infrared absorption characteristics of the printing medium. Alternatively, those improved in thermal conductivity, for example, by using additives in the base sheet and the adhesive layer, or those as thin as possible taking feedability and feeding characteristics into consideration may be used.

The ink-jet printing apparatus capable of feeding the printing media in the form of a cut sheet as described in this example and examples described below is constituted in such a manner that shot-in ink quantity can be controlled or selected according to the thickness and material of the cloth used. In the case where printing is conducted on plain paper, the maximum shot-in ink quantity is limited for reasons of reduction in resolution, bleeding between colors, strike-through and increase in fixing time. In the case of water-based inks, the maximum shot-in ink quantity is generally designed so as to be within a range of from 16 to 28 nl/mm$^2$. In the case where printing is conducted on the printing medium like this example, however, a greater amount of the inks may be received in some cases though it may vary depending upon the material and thickness of the cloth and the conditions of the pretreatment. According to the preferred embodiments, the shot-in ink quantity can thus be increased, as needed, by conducting high-density printing at lower printing speed than a printing speed corresponding to ejecting frequency, for example, double-density printing at a printing speed half of the ejecting frequency, by scanning the same printing area plural times to conduct overlap printing, by controlling the operation of an ink-jet head to increase the ejecting amount of ink, for example, increasing the heat insulation temperature in a thermal ink-jet head, or by conduct multipulse operation. In this example, if the printing mode is designated as "thick cloth" on an operation panel 906, a full-color 300% printing, in which overlap printing is conducted three times on the same printing area, is performed. If "thin cloth" or "plain paper" is specified, a full-color 200% printing or a full-color 100% printing is performed. Therefore, optimum printing conditions can be selected according to the cloth used, and so the printing can be completely conducted to the interior of yarn, thereby obtaining a printed cloth deep in color.

Here, the operation upon the printing on a cloth according to this example is described by reference to FIG. 12. In this example, an image is completed by conducting multipass printing four times. The multipass printing is now described. Printing of a color image requires various factors such as coloring ability, tone reproduction and evenness unlike printing of characters alone with a monochromatic printer. In particular, with respect to the evenness, some scattering by individual nozzles, which may occur in the manufacturing process of a multihead, affects the ejecting amounts and ejecting direction of inks in the individual nozzles upon printing, which finally forms the cause of the deterioration of image quality as unevenness of color strength of the image.

In order to overcome this problem, multipass printing has heretofore been conducted. In this method, the number of dots printed by a nozzle in one scan operation is thinned out to about a half based on a predetermined image data array of the prescribed image data. The printing is hence completed by scanning twice. As the image data array, it is common to use a zigzag lattice-like array. However, more improved form has been proposed by the same applicant as in the present invention in, for example, Japanese Patent Application Laid-Open No. 5-169681. A specific example where this multipass printing is applied to printing on a cloth is illustrated in FIG. 12.

In this mode, an image is completed by conducting printing scan operations eight times in all and paper-feeding scan operations four times. Forward and backward operations of print scanning like the first and second printing scan operations or the third and fourth printing scan operations are made a pair to conduct printing. Each pair of scan operations uses the same thinned-out mask. During both scan operations, no paper-feeding scan operation is interposed. In these two successive scan operations, inks are thus shot on the same picture element by the scan operations in the opposite directions of the forward and backward paths. After the two successive scan operations of the forward and backward directions, the paper-feeding scan operation is conducted by a width of 8 nozzles, and printing on a unit image area is completed by conducting printing scan operations eight times in all.

Figure 12:
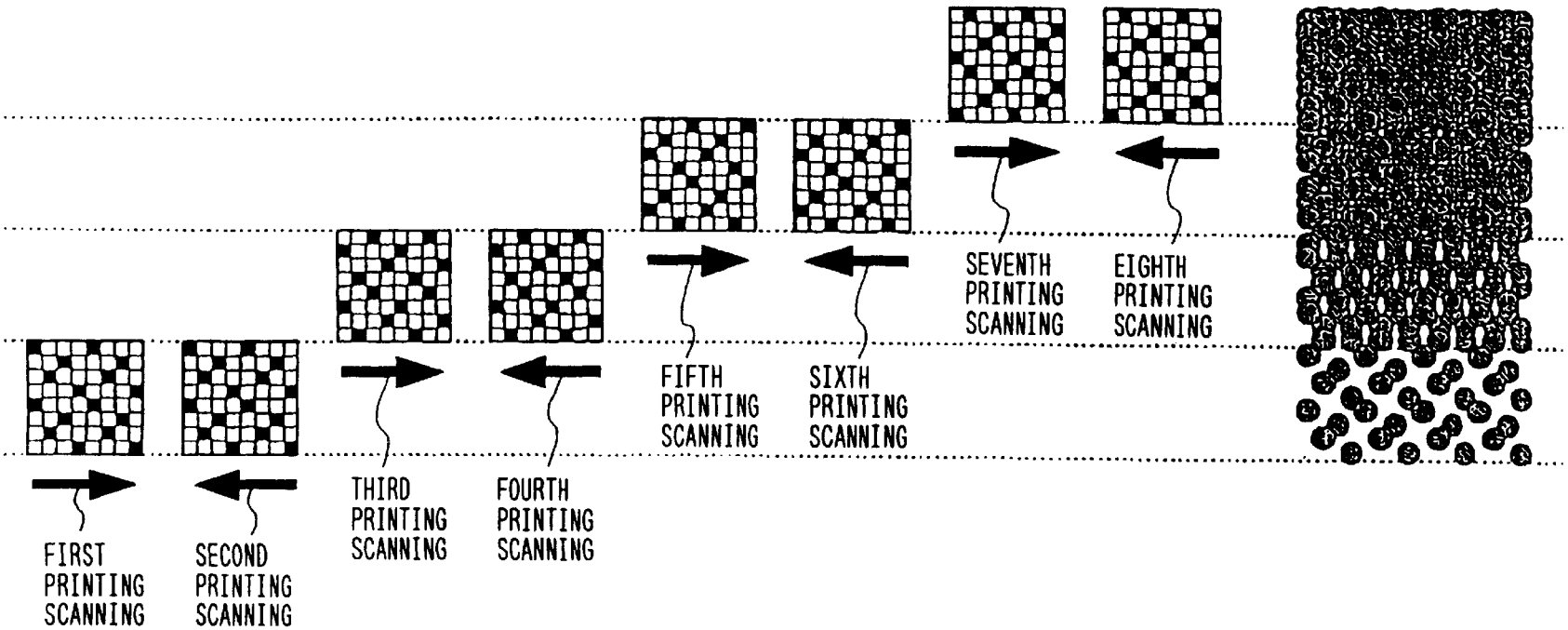
FIG. 12 is an illustration showing a textile printing mode.

Referring to FIG. 12, 200%-duty printing masks in the printing mode as to the cloth in this example have been described. However, a desired color depth may not be achieved in some cases unless the shot-in ink quantity is made a higher duty though depending upon the kind of cloth used. If the 200% duty in FIG. 12 suffices for cyan, magenta and yellow inks, one tends to be fond of a higher density particularly as to only a black ink for the purpose of enhancing the depth of the image and/or heightening contrast.

Figure 13:
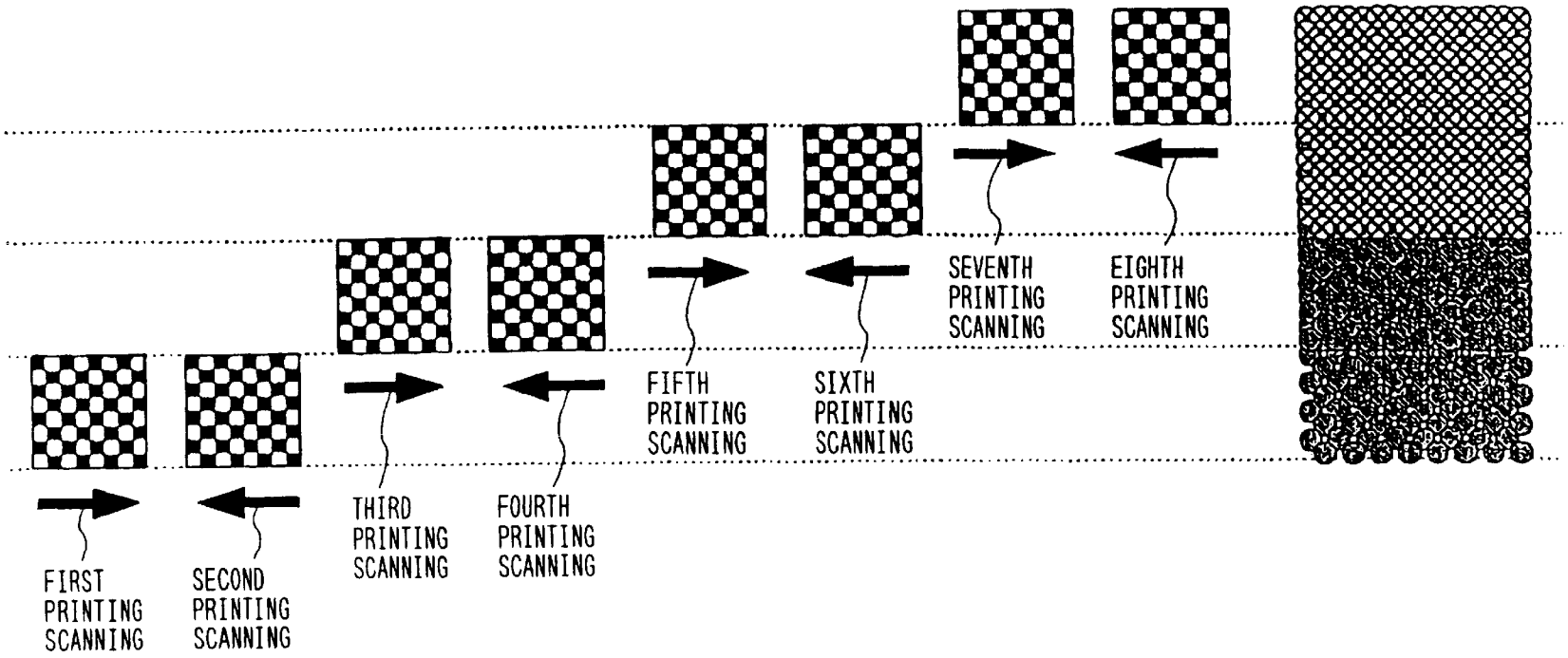
FIG. 13 is an illustration showing an enhanced black mode at the time of textile printing.

FIG. 13 illustrates a printing state that printing scan operations are similar to those in FIG. 12, but a black ink alone is shot in a shot-in ink quantity more than those of the other inks, i.e., a 400% duty. In this drawing, an image is completed by conducting forward and backward printing scan operations eight times in all. A thinned-out mask used in each printing scan operation is a mask thinned out to 50%. Four printing operations in total of the first, second, third and fourth scanning are conducted using the same mask to shoot the black ink on the same picture element four times, thereby shooting a 400% duty of the ink.

In this example and examples described below, an ink-jet printing apparatus equipped with a feed mechanism, a heating mechanism and a shot-in ink quantity increasing mechanism was used to print the media. It was feasible to conduct simple ink-jet printing far excellent in operatability, color yield and color depth.

Example 4

Figure 7:
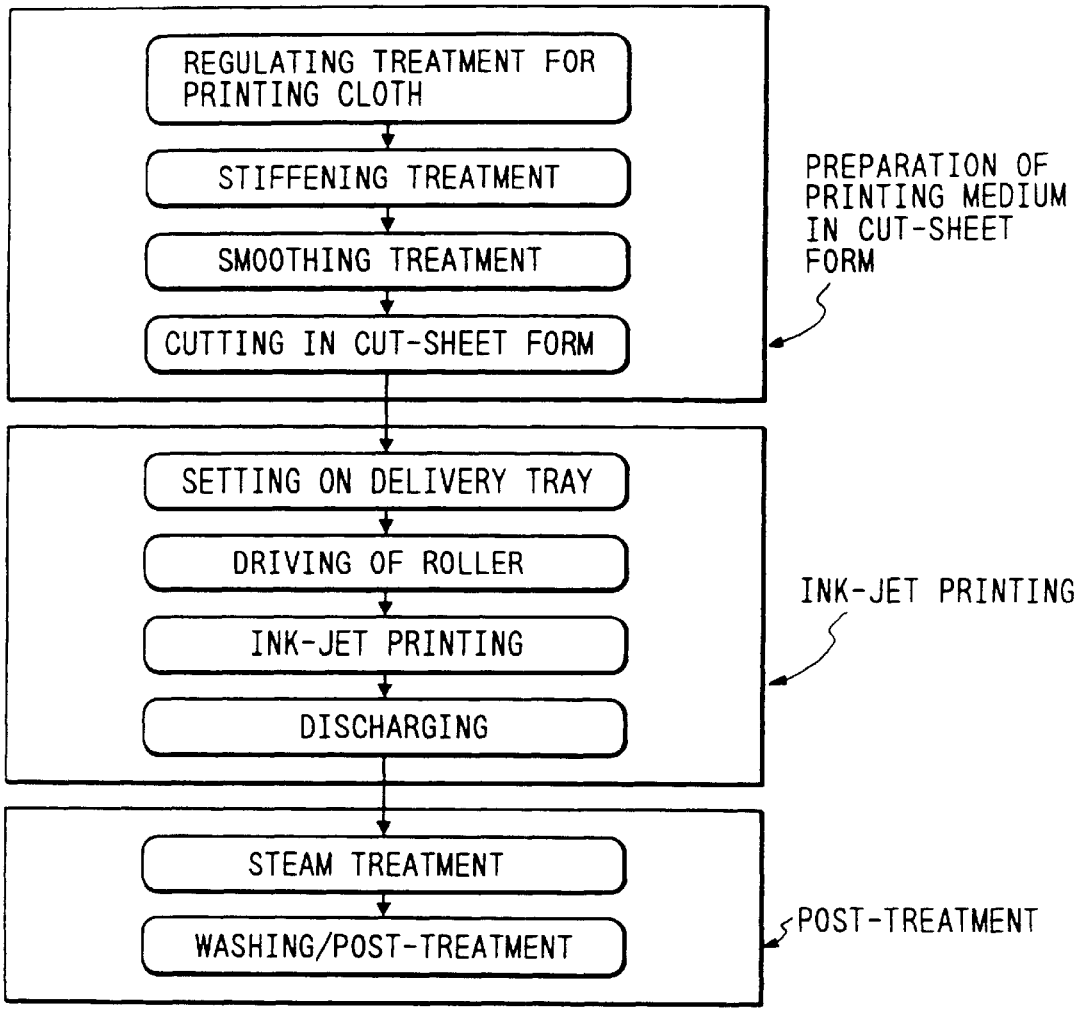
FIG. 7 is a block diagram illustrating a simple ink-jet textile printing process according to another embodiment of the present.
Figure 8:
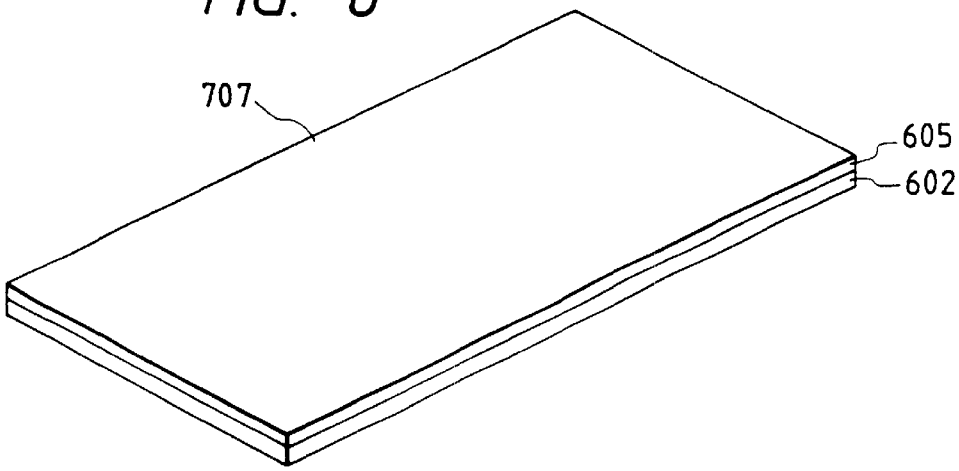
FIG. 8 is a perspective view illustrating a printing medium in the form of a cut sheet according to another embodiment of the present invention.

The ink-jet printing process according to this example will be briefly described by reference to FIGS. 7 and 2. The same ink-jet printing as described in Examples 1 to 3 is conducted on a printing medium 707 in the form of a cut sheet, obtained by subjecting a cloth subjected to a pretreatment (regulating treatment for printing cloth) suitable for ink-jet inks and cloth in advance to the stiffening, smoothing and cutting treatments according to the present invention.

The printed medium discharged from the ink-jet printing apparatus by the feeding means after completion of the printing is air-dried and then subjected to a fixing treatment by heating with steam. Thereafter, the thus-treated medium is subjected to a washing treatment, and then air-dried again to obtain a printed cloth in the form of a cut sheet.

The printing medium used in this example was obtained in the following manner. A 2% aqueous solution (viscosity: 10 Pa·s at 25° C.) is prepared from carboxymethyl cellulose (Nikka Gum M-47, product of Nikka Chemical Ind. Co., Ltd.) as a stiffening agent, and is coated on one side of a cloth 602 subjected to the same regulating treatment for printing cloth as in Example 1 by means of a Meyer bar. In this condition, the cloth contains a considerable amount of liquid. Accordingly, the cloth is then dried at 50° C. for 1 hour to evaporate water as the solvent.

The thus-obtained cloth has wrinkles and irregularities on its surface because the evaporation of water from its surface is not entirely even. In order to remove these wrinkles and irregularities to make the cloth easy to lead to the feeding means of the ink-jet printer and always keep the distance between the tip of an ink ejection orifice of an ink-jet printing head and the cloth constant, it is necessary to smooth the cloth. Thus, this dried cloth is directly ironed out to obtain a smoothed cloth. The thus-obtained cloth had, on its one side, a sizing agent layer 605 composed of carboxymethyl cellulose for stiffening. The cloth was then cut in the same manner as in Example 1.

The printing medium in the form of a cut sheet thus treated was charged in the apparatus illustrated in FIG. 2 to conduct a feeding test. As a result, it was found that neither oblique motion nor wrinkles caused by feeding occurred, and hence very good conveyability was achieved. After the printing medium was thoroughly exposed to the environment of 5° C. and 5% RH, the feeding test was continuously conducted on 50 sheets of the cloth. Even in this case, neither feeding of plural printing media nor attachment of the printing medium to the feeding drive roller, driven roller or the like occurred.

After completion of the ink-jet printing using the same inks as those used in Example 1, the fixing treatment under heat as described above is conducted, followed by its washing. The washing may be conducted by water washing with a commercially-available neutral detergent. However, a treatment agent H may be used for enhancing color yield. This treatment agent H may be provided by packing it in the form of tablets or a sheet together with the printing medium. The treatment agent H is a fixing agent or the like and has as its main object the improvement of wet fastness.

Example 5

A cloth cut out in a size of 210 mm wide and 20 m long was immersed for 20 minutes into a container filled with an aqueous solution (viscosity: 2 Pa·s at 25° C.) as a treatment solution J prepared from 2.5% of sodium alginate (Algitex F5LL, product of Kimitsu Chemical Industries Co., Ltd.) and 97.5% of water, thereby impregnating the whole cloth with the treatment solution J. Thereafter, the cloth was rolled and smoothed by a mangle, and then dried at 120° C. for 10 minutes, thereby obtaining a stiffened cloth. After completion of the drying, the cloth had irregularities caused upon the drying. Therefore, the cloth was caused to pass through between two hot pressure rollers heated to 80° C. and brought into contact with each other, thereby smoothing it. The thus-finished cloth was successively wound up to provide a stiffened cloth subjected to the smoothing.

One end of this cloth was set on the feeding drive roller of the ink-jet printing apparatus illustrated in FIG. 2 to continuously conduct ink-jet printing until it was used up. During this printing, neither wrinkles caused by feeding nor oblique motion occurred, but the cloth could be normally fed to the end. The resulting printed images were always bright without causing unevenness of color strength and the like. After completion of this printing, the printed cloth was exposed for 5 minutes to steam at 100° C. to enhance the color yield of the images. Thereafter, the cloth was washed with water, dried and ironed out. The printed cloth turned its original texture, and the printed images were also bright without fading.

Example 6

After a cloth cut out in the same size as that in Example 4 was subjected to a regulating treatment for printing cloth, an aqueous solution (viscosity: 5 Pa·s at 25° C.) as a treatment solution K prepared from 3% of carboxymethyl cellulose (Finegum HE-L, product of Dai-ichi Kogyo Seiyaku Co., Ltd.) and 97% of water was coated on the cloth by a bar coater in the same manner as in Example 4. Thereafter, the cloth was dried at 120° C. for 10 minutes to obtain a stiffened cloth. This stiffened cloth was then held between two copper plates each having the same area as the cloth. A load of 100 kg was applied to the cloth from the outside of the copper plates to leave the cloth at rest for 5 minutes, thereby smoothing the cloth.

This cloth was set on the feeding drive roller of the ink-jet dying apparatus illustrated in FIG. 2 to continuously conduct ink-jet printing using the same inks as those used in Example 1. During this printing, neither wrinkles caused by feeding nor oblique motion occurred, but the cloth could be normally fed to the end. The resulting printed images were always bright without causing unevenness of color strength and the like. In the case of the treatment in this example, the viscosity is low compared with the treatment solution used in Example 4. Therefore, the complete layer of the sizing agent is not formed on the coated surface of the cloth, but the treatment solution K is partly penetrated in the cloth at their interface. This situation does not interfere with the feeding of the cloth.

In the examples as described above, with respect to the cases where the treatment with the sizing agent is conducted from one side alone and from both sides, respectively, no particular directional properties are present from the viewpoint of both feeding and ink-jet printing.

In the case where a dyeing treatment is conducted after the printing, such a treatment may be performed at a position apart from the printer. However, a heating means may be provided on the downstream side of the ink-jet printing part of the printer so as to subject the printing medium to a heat treatment as needed. As the heating means, any of the heating mechanisms conventionally-known in fields of printers and copying machines may be applied so far as it is constituted so as to achieve a sufficient effect on the improvement of color yield, which is an object of this example. Besides, it is more preferable that the heating means be constituted in such a manner that heating conditions can be suitably controlled and selected according to the structure of the printing medium and the material and thickness of a cloth.

No particular limitation is imposed on the direction of the heating. Therefore, the heating may be conducted from the back surface side of the printed medium. Besides, it is permissible to conduct direct heating from the printing surface side or double-sided heating according to the constitution of the heating means and heating conditions. A contact heating system making use of a heating plate or the like may also be used.

Example 7

Figure 9:
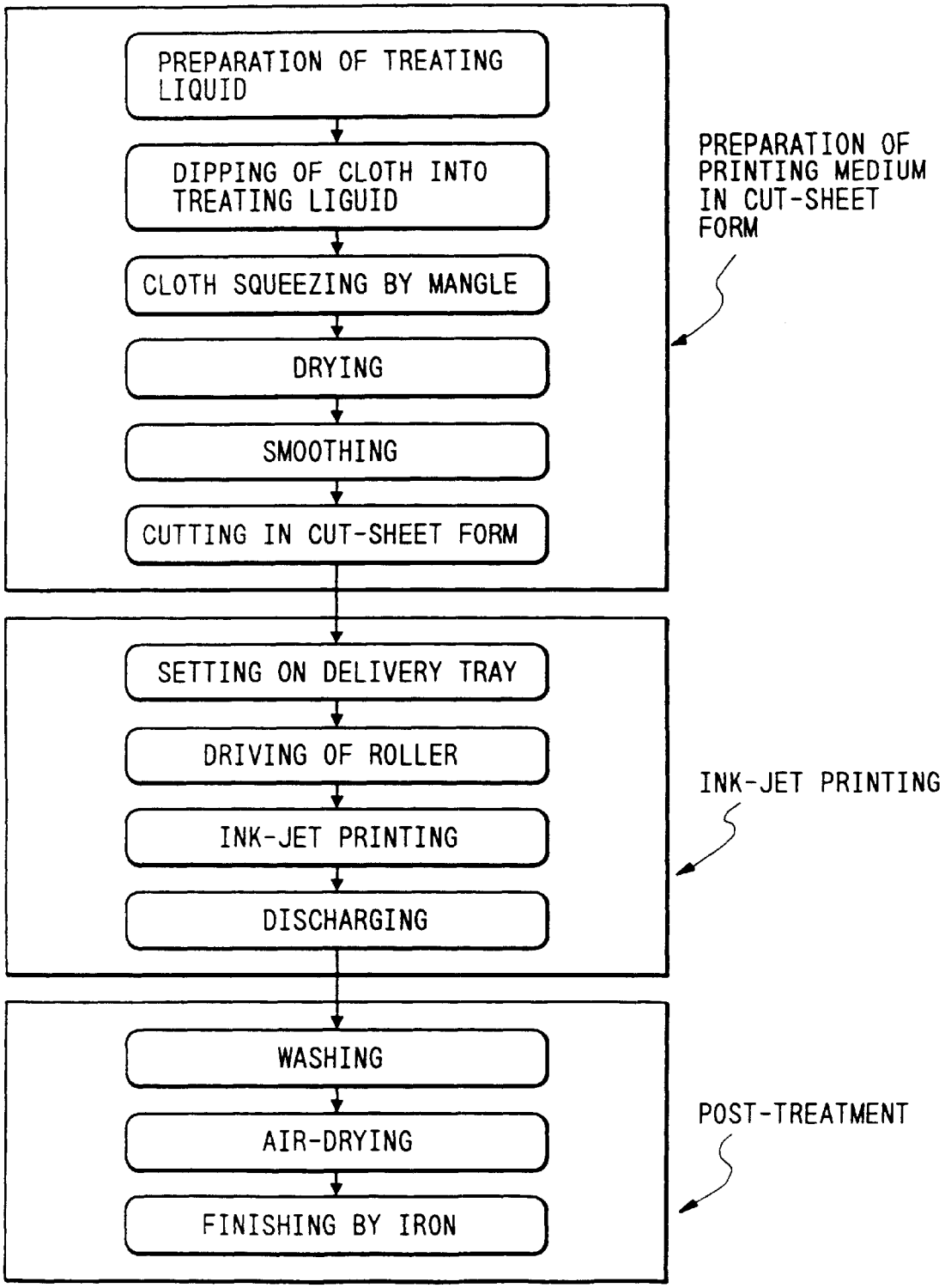
FIG. 9 is a block diagram illustrating a simple ink-jet textile printing process according to a further embodiment of the present.

As shown in the block diagram illustrating an ink-jet textile printing process in FIG. 9, a cloth as a material for a printing medium in the form of a cut sheet was immersed in a treatment solution obtained by mixing a 3% aqueous solution of carboxymethyl cellulose as a stiffening agent and a 5% aqueous solution of polyallylamine hydrochloride as a dye-fixing agent. The thus-treated cloth was subjected to a squeezing process by means of a mangle, followed by its drying. The thus-dried cloth was smoothed and then cut, thereby obtaining a printing medium 707 in the form of a cut sheet.

This printing medium was set in the ink-jet printing apparatus illustrated in FIG. 2 to conduct ink-jet printing using the same inks as those used in Example 1. The printed medium discharged from the ink-jet printing apparatus by the feeding means after completion of the printing was air-dried and then put into water as it is, thereby well washing it by scrubbing with hands for about 2 minutes to run the stiffening agent out of the printing medium. Thereafter, the thus-washed medium was air-dried again, and wrinkles of the cloth were smoothed by a household iron to obtain a printed cloth in the form of a cut sheet.

Upon the treatment of the cloth, the treatment solution were first prepared. In this example, a 3% aqueous solution of carboxymethyl cellulose as a stiffening treatment solution and a 5% aqueous solution of polyallylamine hydrochloride as a dye-fixing treatment solution were separately prepared. These treatment solutions had a pH of 7.1 and 4.3, respectively. Equal amounts of the two solutions were then mixed with each other to provide a treatment solution for the cloth. The cloth was immersed at room temperature for 1 minute in this treatment solution for the cloth, squeezed by a mangle and then dried at 50° C. for 5 minutes. After the drying, the cloth was ironed out and then cut by a slitter along the direction of the grain of the cloth in the same manner as in Example 1.

The printing medium in the form of a cut sheet thus treated was set in the ink-jet printing apparatus illustrated in FIG. 2 to conduct a feeding test. As a result, it was found that neither oblique motion nor wrinkles caused by feeding occurred, and hence very good conveyability was achieved. After the printing medium was thoroughly exposed to the environment of 5° C. and 5% RH, the feeding test was continuously conducted on 50 sheets of the cloth. Even in this case, neither feeding of plural printing media nor attachment of the printing medium to the feeding drive roller, driven roller or the like occurred.

Example 8

A 5% aqueous solution of polyvinyl alcohol as a stiffening treatment solution and a 3% aqueous solution of polyallylamine hydrochloride as a dye-fixing treatment solution were separately prepared. These treatment solutions had a pH of 6.9 and 4.8, respectively. A cloth cut out in a size of 210 mm wide and 20 m long was first entirely impregnated with the dye-fixing treatment solution and dried for 10 minutes in a drying oven at 45° C. while successively winding it up. The thus-treated cloth was then impregnated with the stiffening treatment solution in the same manner as described above, and then dried at 80° C. for 10 minutes while winding it up, thereby obtaining a stiffened printing medium in the form of a roll.

One end of this cloth was set on the feeding drive roller of the ink-jet printing apparatus illustrated in FIG. 2 to continuously conduct ink-jet printing until it was used up. At this time, the ink-jet printing was conducted while introducing hot air at 35° C. for the purpose of facilitating the fixing of the inks on the cloth upon the printing.

Thereafter, this cloth was washed with hot water at 40° C. for 10 minutes in a household washing machine to remove the stiffening agent, and dried for 2 minutes in a dehydrator. After completion of the washing, washings were clear, and bright printed images were left on the cloth.

The cloth was gradually dried under heat by hot press plates heated to 100° C. from an end of the roll cloth, thereby providing a roll of printed cloth of 20 m long.

Example 9

A 2 % aqueous solution of tragacanth gum as a stiffening treatment solution and a 5% aqueous solution of polyallyl sulfone as a dye-fixing treatment solution were separately prepared. These treatment solutions had a pH of 7.0 and 4.0, respectively. One side of a cloth cut out in the same size as that in Example 7 was coated with the dye-fixing treatment solution by a Meyer bar, and the thus-coated cloth was dried with hot air at 50° C. Thereafter, the other side of the cloth was coated with the stiffening treatment solution by a Meyer bar, and the thus-coated cloth was dried again with hot air at 50° C. These treatments provided a printing medium in the form of a cut sheet.

Using the same apparatus as that used in Example 7, ink-jet printing was conducted on this printing medium.

Thereafter, this cloth was washed with tap water for 7 minutes in a household washing machine to remove the stiffening agent, and dried for 1 minute in a dehydrator. After completion of the washing, washings were clear, and bright printed images were left on the cloth.

The thus-treated cloth was applied with sufficient heat by a household iron to smooth wrinkles of the cloth to obtain a printed cloth.

In Examples 7 to 9, the cloths were treated in varied processes. In any process, however, bright images were always left on the cloth after the washing. The cloth held dye well.

Although the present invention has been described above with reference to the examples, the printing media according to present invention may be applied to various types of printing apparatus. When they are applied to ink-jet printing systems, they have excellent effects by using a printing head and a printing apparatus of, among others, a system in which a means for generating thermal energy as energy used for ejecting inks is provided, and the thermal energy induces change of state of the inks, namely, a bubble jet system proposed by Canon, Inc. According to such a system, a high-density, high-definition print can be obtained.

As components of the printing apparatus according to the present invention, an ejection-purging means for the printing head, preliminary auxiliary means and the like may preferably be added because the effects of the present invention can be more stabilized. As specific examples thereof, may be mentioned capping means for the printing head, wiping means, purging means, preliminary heating means for conducting heating by means of an electrothermal converter or another heating elements or a combination thereof, and preliminary ejecting means for conducting another ejection other than for printing.

In the examples of the present invention as described above, the inks have been described as a liquid. However, inks which are solid at room temperature or lower, but turn liquid at a temperature higher than room temperature may be used. Alternatively, since it is common in the ink-jet system that ink itself is temperature-controlled within a range of from not lower than 30° C. to not higher than 70° C. so as to control the viscosity of the ink within a stably ejecting range, an ink which turns liquid upon the application of a printing signal to the effect that the ink is used may be used. In addition, in order to positively prevent the rise of temperature by thermal energy or prevent the evaporation of ink, an ink which solidifies in a stand-by state, but turns liquid under heat may be used. In any event, even in the case where inks of a nature that liquefy for the first time by the application of thermal energy, such as an ink that liquefies upon the application of thermal energy according to a printing signal to eject in the form of liquid, and an ink that already starts to solidify at the time it reaches a printing medium, are used, the present invention can be applied. Such an ink may be constituted so as to face an electrothermal converter in a state that it has been held in recesses or through-holes of a porous sheet as described in Japanese Patent Application Laid-Open No. 54-56847 or 60-71260. In the present invention, it is most effective for the inks described above to perform a film boiling system.

Moreover, the application forms of the present invention may include image output terminals for information processing instruments such as computers and besides copying machines combined with readers or the like.

Ink-jet printing cloths are required to have the following performance characteristics:

(1) being able to develop the color of ink to a sufficient color depth;

(2) being high in color yield of ink;

(3) causing ink on the cloth to quickly dry;

(4) undergoing little irregular bleeding of ink on the cloth; and (5) being excellent in feedability in an apparatus.

In order to satisfy these performance characteristics required in the present invention, the cloth may be subjected to a pretreatment in advance as needed. For example, Japanese Patent Application Laid-Open No. 62-53492 discloses cloths having an ink-receiving layer. Besides, Japanese Patent Publication No. 3-46589 proposes cloths containing a reduction preventing agent or an alkaline substance. As examples of such a pretreatment, may be mentioned a treatment in which a substance selected from alkaline substances, water-soluble polymers, synthetic polymers, water-soluble metal salts, urea and thiourea is contained in a cloth.

A printing textile ink to be applied to an ink-jet printing cloth only adheres to the cloth in a state applied to the cloth. Accordingly, the cloth must be subsequently subjected to a process for fixing coloring matter such as a dye in the ink to the fibers. Such fixing process may be conducted in accordance with methods known per se in the art. Examples thereof include a steaming process, an HT steaming process, a thermofix process, or in the case where no alkali-treated cloth is used, an alkaline pad-steam process, an alkaline blotch-steam process, an alkaline shock process, an alkaline cold fix process, and the like. The fixing processes include those comprising a reaction process and those comprising no reaction process. An example of the latter includes a process in which the coloring matter is impregnated into fibers to physically prevent elimination. As inks, any inks may suitably be used so far as they contain needed coloring matter. The inks may contain not only dyes, but also pigments.

The removal of unreacted dyes and substances used in the pretreatment may be conducted by washing in accordance with methods known per se in the art. By the way, the washing may preferably be combined with the conventional fixing treatment.

The printed cloth subjected to the above-described treatments is then cut out into desired sizes, and the cut pieces are subjected to processes required to obtain final processed articles, such as sewing, bonding and/or welding, thereby obtaining apparel such as one-piecers, dresses, neckties or bathing suits, bed covers, sofa covers, handkerchiefs, curtains, or the like. Methods in which a cloth is processed by sewing and/or the like to obtain apparel or other daily needs are described in many known books, for example, "Saishin Nitto Hosei Manual (The Newest Knitting and Sewing Manual)", published by Seni Journal Co.; a monthly magazine, "Soen", published by Bunka Shuppan Kyoku; etc.

The printing media include cloth, wall cloth, yarn used in embroidery, wall paper, paper, films for OHP, etc. The cloth includes all fabrics, non-woven fabrics and other fabrics or cloths irrespective of material, the way to weave and the way to knit.

According to the present invention, both the printing medium in the form of a cut sheet improved in feedability by enhancing its stiffness and an ink-jet printing apparatus including a feeding means fitted to the medium are provided, whereby a simple textile printing process and an apparatus using an ink-jet technique can be provided. Besides, since the high-definition color representation according to the simple ink-jet printing process using the ink-jet technique can be performed by a simple operation, it is possible to apply the color representation to not only an industrial field, but also a field of textile printing for pleasure in general homes.

According to the present invention, the stiffening treatment is subjected to the printing medium such as a cloth with a sizing agent or the like, and the thus-treated medium is then subjected further to a smoothing treatment. Therefore, the stiffness of the cloth is strengthened to enhance its feedability, and moreover the distance between the cloth and the ink ejection orifice of an ink-jet printing head is always kept constant, whereby image quality can be maintained stably. Further, this stiffening treatment can help the cloth to have good hygroscopicity, thereby permitting the prevention of frictional electrification.

According to the present invention, in order to subject a printing medium, in particular, a cloth to a stiffening treatment with a non-anionic material and to a dye-fixing treatment with a cationic material, a stiffening agent having an ionicity which undergoes no ionic bonding to a dye and a dye-fixing agent having an ionicity opposite to that of the dye are applied to the cloth. Therefore, the stiffness of the cloth as the printing medium is strengthened to enhance its feedability. Besides, even when washing the cloth as it is after printing such as ink-jet printing is conducted, a printed image which holds dye well can be provided. In this case, it is possible to omit post-treatments such as heating, steaming and the like.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. A printing medium for an ink jet printer having an ink ejection orifice and supporting means provided facing the orifice for supporting a printing medium, said printing medium having a Clark stiffness not lower than 10, but not higher than 400 at least at its ends and comprising a cloth and a stiffening agent having a non-dyeing property imparted to the cloth and being subjected to a smoothing treatment at its surface so that a degree of the irregularity of the surface is smaller than a half of the distance between the ink-ejection orifice and the surface of the supporting means of the ink-jet printer.

2. The printing medium according to claim 1, wherein said medium is processed in the form of a cut sheet.

3. The printing medium according to claim 1, wherein said cloth is subjected to a cationizing treatment.

4. The printing medium according to claim 1, wherein said stiffening agent comprises a water-soluble non-dyeing compound as a principle component.

5. The printing medium according to claim 4, wherein the stiffening agent comprises a material selected from the group consisting of carboxymethyl cellulose, polyvinyl alcohol, sodium alginate, sodium polyacrylate, polyacrylates, starch, dextrin, tragacanth gum and locust bean gum.

6. The printing medium according to claim 1, wherein the stiffening agent is contained in the cloth in a range of from 0.01 to 20% by weight based on the weight of the cloth.

7. The printing medium according to claim 1, wherein said cloth is in the form of a rectangular cut sheet having two pairs of parallel sides, and having a non-laminated structure, and wherein the direction of crosswise grain or lengthwise grain of said cloth is aligned in a direction parallel with one of the two pairs of parallel sides.

8. The printing medium according to claim 1, having a Clark stiffness not lower than 25, but not higher than 300 at least at its ends.

9. The printing medium according to claim 1, wherein said stiffening agent comprises sodium alginate.

* * * * *

UNITED STATES PATENT AND TRADEMARK OFFICE

CERTIFICATE OF CORRECTION

PATENT NO. : 6,472,051 B2 
DATED : October 29, 2002
INVENTOR(S) : Hiromitsu Hirabayashi et al.

It is certified that error appears in the above-identified patent and that said Letters Patent is hereby corrected as shown below:

Title page,
Item [56], References Cited, FOREIGN PATENT DOCUMENTS,

"JP 39005985 4/1939" should read -- JP 39-5985 4/1964 --
"JP 46040510 11/1971" should read -- JP 46-40510 11/1971 --
"JP 54056847 5/1979" should read -- JP 54-56847 5/1979 --
"JP 60071260 4/1985" should read -- JP 60-71260 4/1985 --
"JP 60134080 7/1985" should read -- JP 60-134080 7/1985 --
"JP 61055277 3/1986" should read -- JP 61-55277 3/1986 --
"JP 62053492 3/1987" should read -- JP 62-53492 3/1987 --
"JP 1210377 8/1989" should read -- JP 1-210377 8/1989 --
"JP 3046589 7/1991" should read -- JP 3-46589 7/1991 --
"JP 5169681 7/1993" should read -- JP 5-169681 7/1993 --

Drawings,
Sheet 7, Figure 9 "LIGUID" should read -- LIQUID --

Column 11,
Line 65, "contact" should read -- contact with --.

Column 15,
Line 13, "may" should read -- may be --.

Column 23,
Line 6, "conduct" should read -- conducting a --.

Signed and Sealed this

Twenty-second Day of July, 2003

JAMES E. ROGAN
*Director of the United States Patent and Trademark Office*